US010031487B2

(12) United States Patent
Fujisawa

(10) Patent No.: US 10,031,487 B2
(45) Date of Patent: Jul. 24, 2018

(54) ELECTRONIC TIMEPIECE

(71) Applicant: Seiko Epson Corporation, Tokyo (JP)

(72) Inventor: Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/451,851

(22) Filed: Mar. 7, 2017

(65) Prior Publication Data

US 2017/0261944 A1 Sep. 14, 2017

(30) Foreign Application Priority Data

Mar. 9, 2016 (JP) ..... 2016-045576

(51) Int. Cl.
*G04R 60/10* (2013.01)
*G04R 20/02* (2013.01)

(52) U.S. Cl.
CPC ..... *G04R 20/02* (2013.01); *G04R 60/10* (2013.01)

(58) Field of Classification Search
CPC ..... G04R 20/02; G04R 60/10; G04B 19/06; G04B 19/065; G04G 21/04
See application file for complete search history.

(56) References Cited

U.S. PATENT DOCUMENTS 8,072,844 B2 * 12/2011 Miyahara ..... G04G 21/04 343/788
9,411,315 B2 * 8/2016 Sawada ..... G04R 20/02
9,897,979 B2 * 2/2018 Fujisawa ..... G04R 20/02
2006/0171258 A1 * 8/2006 Nirasawa ..... G04G 21/04 368/47
2007/0041275 A1 * 2/2007 Barras ..... G04G 21/04 368/14
2014/0022871 A1 * 1/2014 Fujisawa ..... G04G 5/002 368/28
2014/0233358 A1 * 8/2014 Fujisawa ..... G04G 5/002 368/47
2015/0092521 A1 * 4/2015 Fujisawa ..... G04G 5/002 368/47
2015/0268636 A1 9/2015 Sawada
2016/0357160 A1 12/2016 Fujisawa

FOREIGN PATENT DOCUMENTS

JP 2008-051697 A 3/2008
JP 2015-175839 A 10/2015
JP 2017-003304 A 1/2017

* cited by examiner

*Primary Examiner* — Sean Kayes
(74) *Attorney, Agent, or Firm* — Harness, Dickey & Pierce, P.L.C.

(57) ABSTRACT

A thin electronic timepiece can receive satellite signals and standard time signals. An electronic timepiece has a planar antenna for receiving satellite signals, a bar antenna for receiving standard time signals, a time display unit with a plurality of hands, a plurality of motors for driving the hands, a battery, and a timepiece case. In a plan view of the electronic timepiece, the planar antenna, bar antenna, and battery are disposed to positions not mutually superimposed; the plural motors are disposed inside the timepiece case at positions not superimposed in plan view with the planar antenna and bar antenna; and at least one of the plural motors is disposed superimposed in plan view with the battery inside the timepiece case.

5 Claims, 21 Drawing Sheets

ELECTRONIC TIMEPIECE

BACKGROUND

1. Technical Field

The present invention relates to an electronic timepiece that receives either satellite signals from GPS satellites or standard time signals from a transmission station, acquires time information, and corrects the time.

2. Related Art

Electronic timepieces that receive satellite signals from GPS satellites or standard time signals from long-wave standard time signal transmission stations, acquire time information, and correct the time, are known from the literature. See, for example, JP-A-2015-175839.

Such electronic timepieces have two antennae, a patch antenna for receiving high frequency GPS signals, and a bar antenna for receiving long-wave standard time signals. Receiving GPS satellite signals is power-consumption intensive, and such timepieces require a relatively large capacity button battery (storage battery) to receive GPS satellite signals. Further, multiple dials and hands, and motors to drive the different hands, are also used in addition to the typical hour, minute, and second hands to provide a multi-functional display.

The storage battery and patch antenna in such electronic timepieces are disposed overlapping in the thickness direction of the timepiece. The thickness of the movement in a timepiece having a storage battery, patch antenna, and bar antenna therefore increases, making achieving a thin electronic timepiece difficult.

SUMMARY

An electronic timepiece according to the invention reduces the thickness of a timepiece capable of receiving satellite signals and standard time signals.

An electronic timepiece according to one aspect of the invention has a planar antenna for receiving satellite signals, a bar antenna for receiving standard time signals, a time display unit with a plurality of hands, a plurality of motors for driving the hands, a battery, and a timepiece case. The planar antenna, bar antenna, and battery are disposed to positions not mutually superimposed in plan view inside the timepiece case; the plural motors are disposed inside the timepiece case at positions not superimposed in plan view with the planar antenna and bar antenna; and at least one of the plural motors is disposed superimposed in plan view with the battery inside the timepiece case.

That the planar antenna, bar antenna, battery, motors, or other parts are not mutually superimposed in plan view inside the timepiece case means that the parts are not superimposed in plan view when seen perpendicularly to the dial of the electronic timepiece.

Because the electronic timepiece has a planar antenna for receiving satellite signals, and a bar antenna for receiving standard time signals, both satellite signals and standard time signals can be received. As a result, compared with an electronic timepiece having only one type of antenna, the possibility of receiving at least one of the signals is improved, and the probability of acquiring time information can be improved.

Furthermore, because the parts disposed inside the timepiece case that are relatively thick, including the planar antenna, bar antenna, and battery, are not superimposed in plan view, a thin electronic timepiece can be achieved. In addition, because the plural motors are disposed to positions not superimposed in plan view with the planar antenna and bar antenna, the thickness of the electronic timepiece can be further reduced.

Yet further, because at least one of the plural motors is disposed superimposed in plan view with the battery (a position overlapping in plan view), the plane size (diameter) of the timepiece case can be reduced and the thickness of the electronic timepiece can be reduced compared with a configuration in which all motors are superimposed in plan view with the battery.

Furthermore, because the thickness of the motors and battery is less than the thickness of the planar antenna and bar antenna, the thickness of the electronic timepiece can be reduced and the electronic timepiece can be made thinner when the motor is superimposed in plan view with the battery than when the motors are superimposed in plan view with the antennae.

Furthermore, when the motors are superimposed in plan view with the battery, the metal battery functions as a magnetic shield, and the motor can be prevented from operating incorrectly as a result of external magnetic fields affecting the motor coils.

An electronic timepiece according to another aspect of the invention has a planar antenna for receiving satellite signals, a bar antenna for receiving standard time signals, a time display unit with a plurality of pivots and hands attached to the pivots, a plurality of motors for driving the hands, a battery, and a timepiece case. The planar antenna, bar antenna, and battery are disposed to positions not mutually superimposed in plan view inside the timepiece case; the plural pivots are disposed inside the timepiece case at positions not superimposed in plan view with the planar antenna and bar antenna; and at least one of the plural pivots is disposed superimposed in plan view with the battery inside the timepiece case.

Because there are two types of antennae, a planar antenna that receives satellite signals, and a bar antenna that receives standard time signals, both satellite signals and standard time signals can be received. As a result, compared with an electronic timepiece having only one type of antenna, the possibility of receiving at least one of the signals is improved, and the probability of acquiring time information can be improved.

Furthermore, because the parts disposed inside the timepiece case that are relatively thick, including the planar antenna, bar antenna, and battery, are not superimposed in plan view, a thin electronic timepiece can be achieved. In addition, because the pivots are disposed to positions not superimposed in plan view with the planar antenna and bar antenna, the thickness of the electronic timepiece can be further reduced.

Yet further, because at least one of the plural pivots is disposed superimposed in plan view with the battery, when the hands are pressed onto the pivot, the force applied to the pivot can be borne by the battery, which is superimposed in plan view with the pivot. As a result, the force applied when the hands are pushed onto the pivot can be borne by the metal battery, which has greater strength than a plastic part, and the hands can be reliably and stably installed.

Preferably, the electronic timepiece also has a solar cell disposed inside the timepiece case; an electrode layer of the solar cell is not superimposed in plan view with the planar antenna, and an electrode layer of the solar cell is superimposed in plan view with the bar antenna.

The solar cells have an amorphous silicon semiconductor thin film formed as the photovoltaic layer on a plastic base film with an aluminum or other back electrode therebetween, and a transparent electrode (surface electrode) is formed on the surface of the photovoltaic layer. Because the frequency of satellite signals (GPS satellite signals) is a high 1575.42 MHz, signal are attenuated and antenna performance drops even where there is a thin metal layer such as the transparent electrode of the solar cell. The bar antenna that receives standard time signals (40-77.5 kHz), however, can receive standard time signals even if superimposed with the electrodes of the solar cell.

Because the electrode layer of the solar cell and the planar antenna are not superimposed in plan view, a drop in the reception process of the planar antenna can be prevented. In addition, because the electrode layer of the solar cell and the bar antenna are superimposed in plan view, the area of the solar cells can be increased and sufficient power generation can be assured.

An electronic timepiece according to another aspect of the invention preferably also has a first circuit board and a second circuit board inside the timepiece case. A control chip for controlling driving the motors, and a power control chip for controlling a power supply including the battery, are disposed to the first circuit board; and the planar antenna, bar antenna, a satellite signal receiver chip for controlling receiving satellite signals by the planar antenna, and a standard time signal receiver chip for controlling receiving standard time signals by the bar antenna, are disposed to the second circuit board.

Because the antennae and the receiver chips for each antenna are disposed to the second circuit board, the signal path from the antennae to the receiver chips can be shortened, and the chance of noise interfering with the signals received by the antennae can be reduced. As a result, the receiver chips can process signals with less noise interference, and the possibility of acquiring the correct time information can be improved.

Furthermore, because the chips for controlling motor drive, and the power supply control chip, are on the first circuit board, which is different from the second circuit board, the first circuit board and second circuit board can be desirably separated, and the motor drive signals, for example, can be prevented from affecting the received signals.

An electronic timepiece according to another aspect of the invention also has a first magnetic shield and a second magnetic shield disposed inside the timepiece case; the first magnetic shield and second magnetic shield being not superimposed in plan view with the planar antenna and bar antenna.

Because this aspect of the invention has two magnetic shields, a first magnetic shield and a second magnetic shield, the first magnetic shield and a second magnetic shield can be disposed respectively on the face and back cover sides of the motors. Motors can therefore be protected from the effects of external magnetic fields from both the face and back cover sides, and incorrect operation of the motors can be prevented.

Furthermore, because the parts of the magnetic shields that would otherwise be superimposed in plan view with the antennae are removed, the signals received by the antennae are protected from interference by the magnetic shields, and good reception performance can be assured.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. In this embodiment of the invention, the crystal 33 side of the electronic timepiece 1 is referred to as the face (top, front) side, and the back cover 34 side is the back (bottom) side.

Electronic Timepiece

Figure 1:
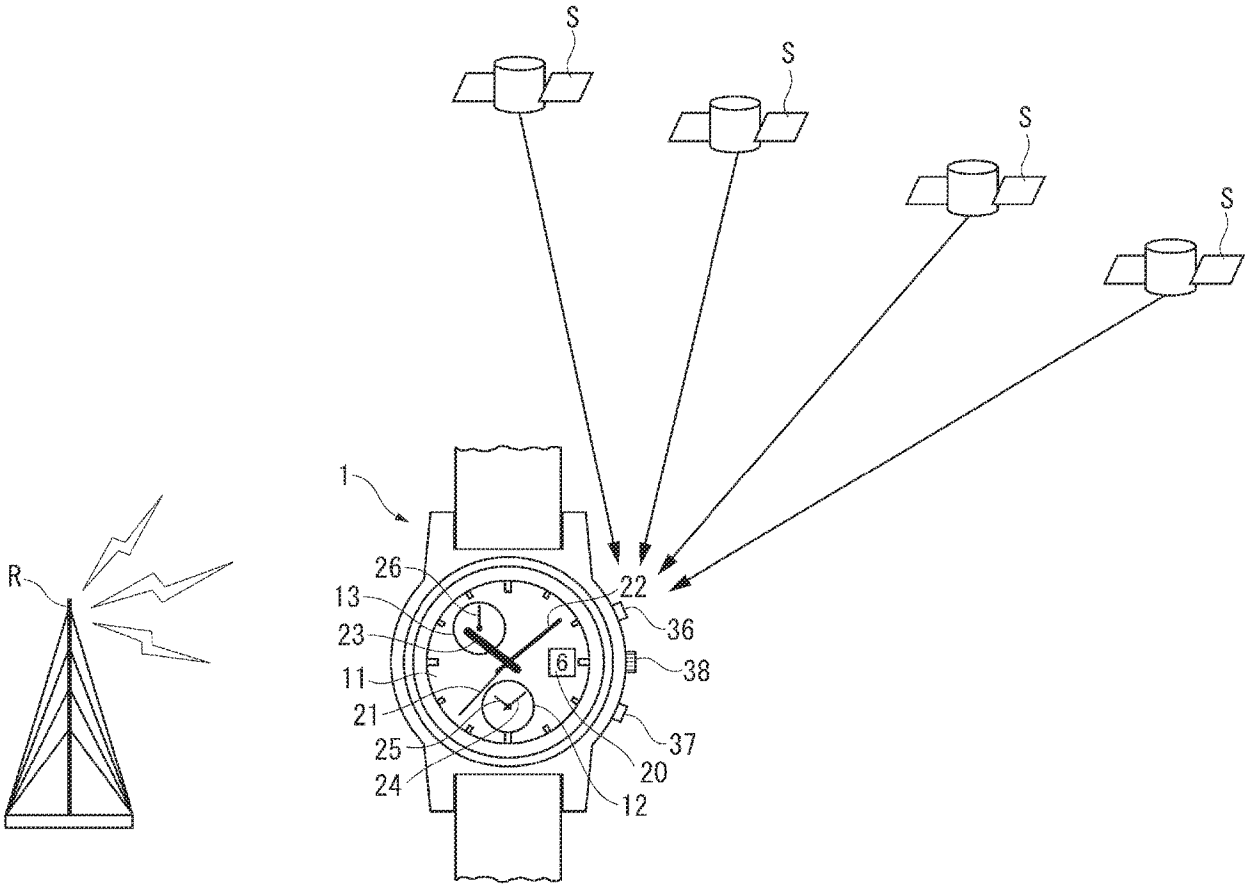
FIG. 1 is a plan view showing an electronic timepiece according to a preferred embodiment of the invention.

As shown in FIG. 1, the electronic timepiece 1 is configured to receive both standard time signals from a standard time signal transmitter R, and satellite signals from a plurality of GPS satellites orbiting the Earth on specific known orbits.

The electronic timepiece 1 is configured to receive standard time signals from a standard time signal transmitter R and acquire time information for the country where the transmitter R is located.

The electronic timepiece 1 is configured to execute a reception process in a timekeeping mode (timekeeping reception process), and a reception process in a positioning mode (positioning reception process). The timekeeping mode is a mode in which satellite signals are received from one or more GPS satellites, and the internal time of the electronic timepiece 1 is corrected based on the time information carried in the satellite signals.

The positioning mode is a mode in which satellite signals are received from three or more (and preferably four or more) GPS satellites, the distance from the electronic timepiece 1 to each of the GPS satellites S and the current location of the electronic timepiece 1 are calculated using the orbit information and time information contained in the satellite signals, the time zone information of the time indicated by the electronic timepiece 1 is corrected based on the current position of the electronic timepiece 1, and the internal time of the electronic timepiece 1 is corrected based on the time information and time zone information acquired from the satellite signals.

When time information is received from a standard time signal, the electronic timepiece 1 corrects the internal time information, which is kept internally by the electronic timepiece 1, based on the received time information. When time information is received from satellite signals, the electronic timepiece 1 can correct the internal time information based on the received time information and the time zone information.

The time zone information can be set based on the positioning information calculated from the satellite signals, and map information stored in the electronic timepiece 1. The user may also manually select and set the time zone information by operating buttons 36, 37 or the crown 38 of the electronic timepiece 1.

Configuration of the Electronic Timepiece

Figure 2:
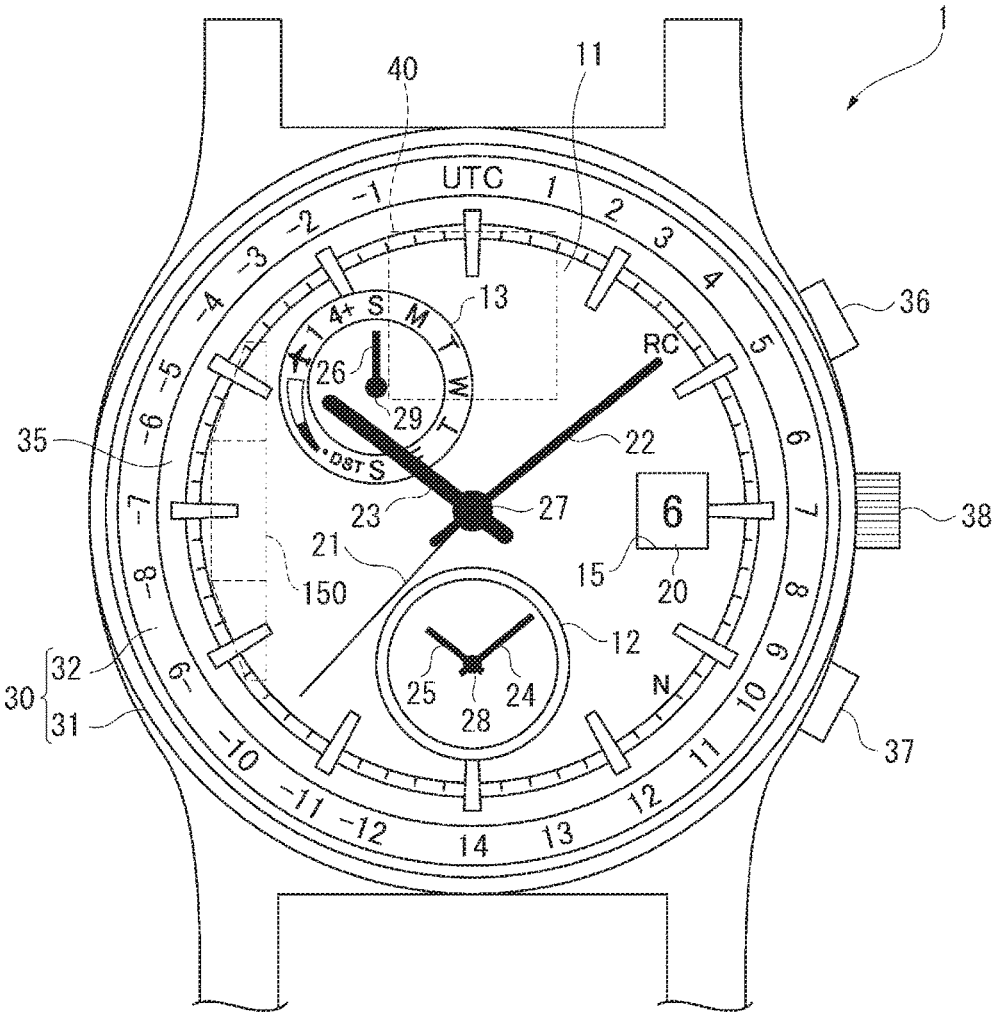
FIG. 2 shows the face of the electronic timepiece.
Figure 5:
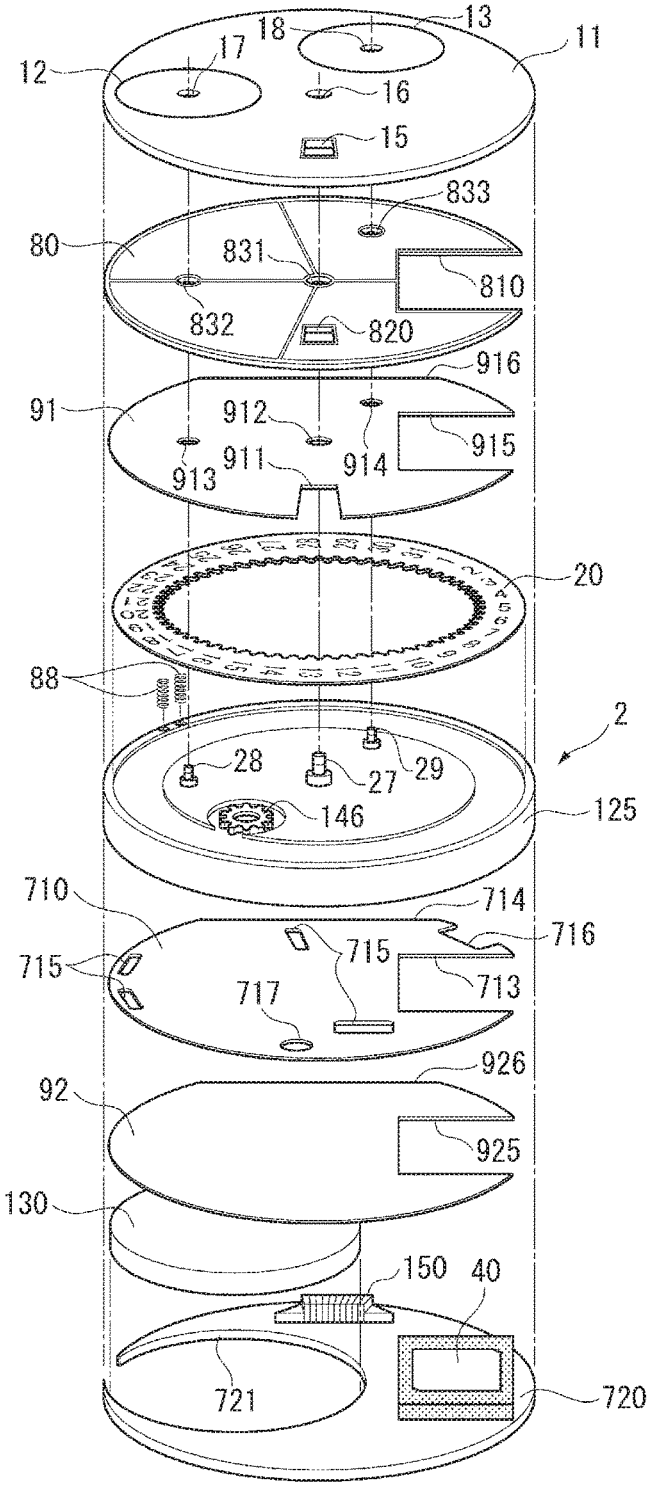
FIG. 5 is a partially exploded oblique view showing main parts of the electronic timepiece.
Figure 6:
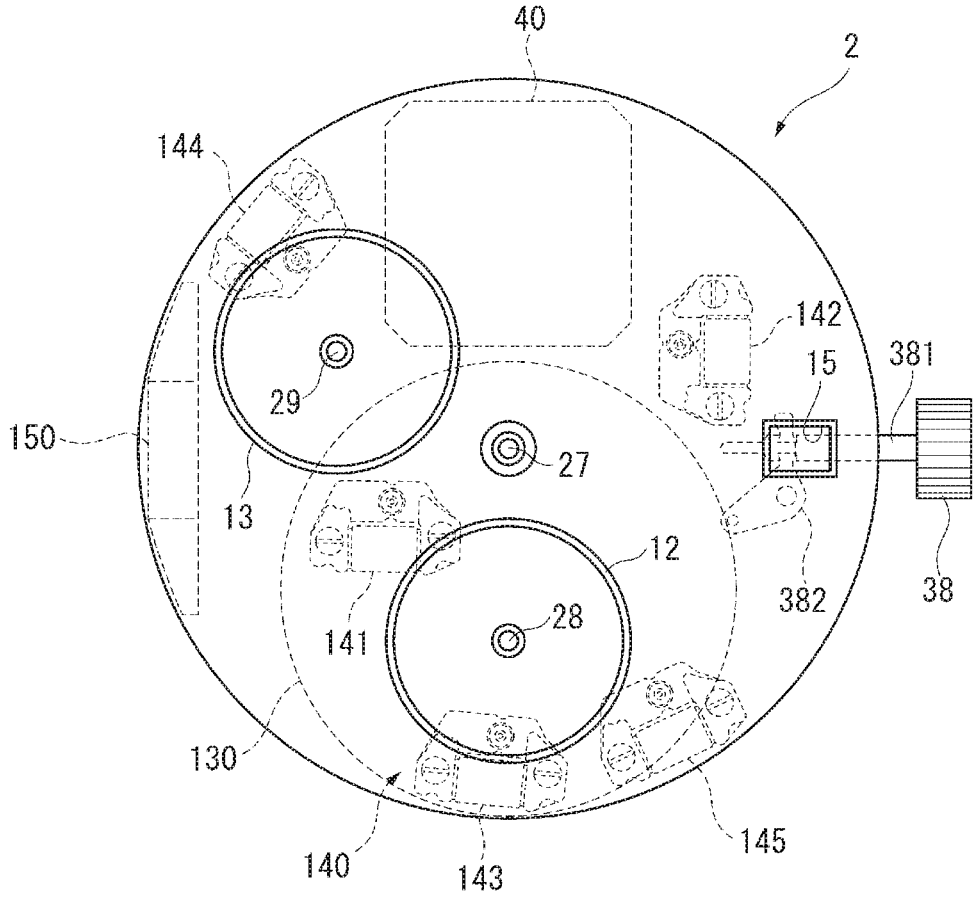
FIG. 6 is a plan view showing the locations of a planar antenna, bar antenna, battery, and stepper motors in the electronic timepiece of the invention.

The configuration of an electronic timepiece 1 that can receive standard time signals and satellite signals is described next. FIG. 2 shows the face of the electronic timepiece 1, FIG. 3 is a section view of the electronic timepiece 1 through a line between 6:00 and 12:00 on the electronic timepiece 1, FIG. 4 is a section view through a line between 3:00 and 9:00 on the electronic timepiece 1, FIG. 5 is a partially exploded oblique view of the electronic timepiece 1, and FIG. 6 is a plan view showing main parts of the electronic timepiece 1.

Figure 3:
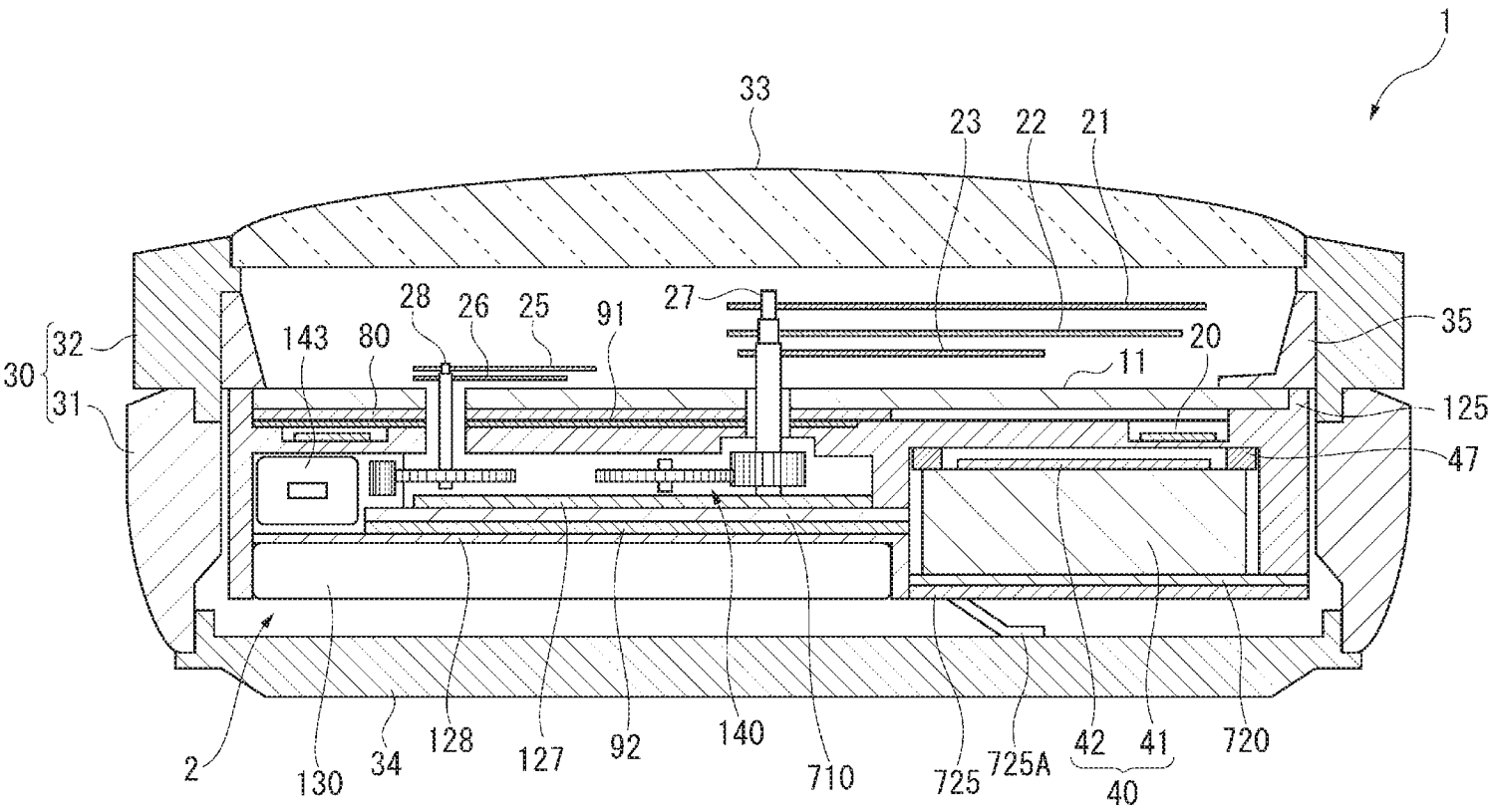
FIG. 3 is a section view of the electronic timepiece.
Figure 4:
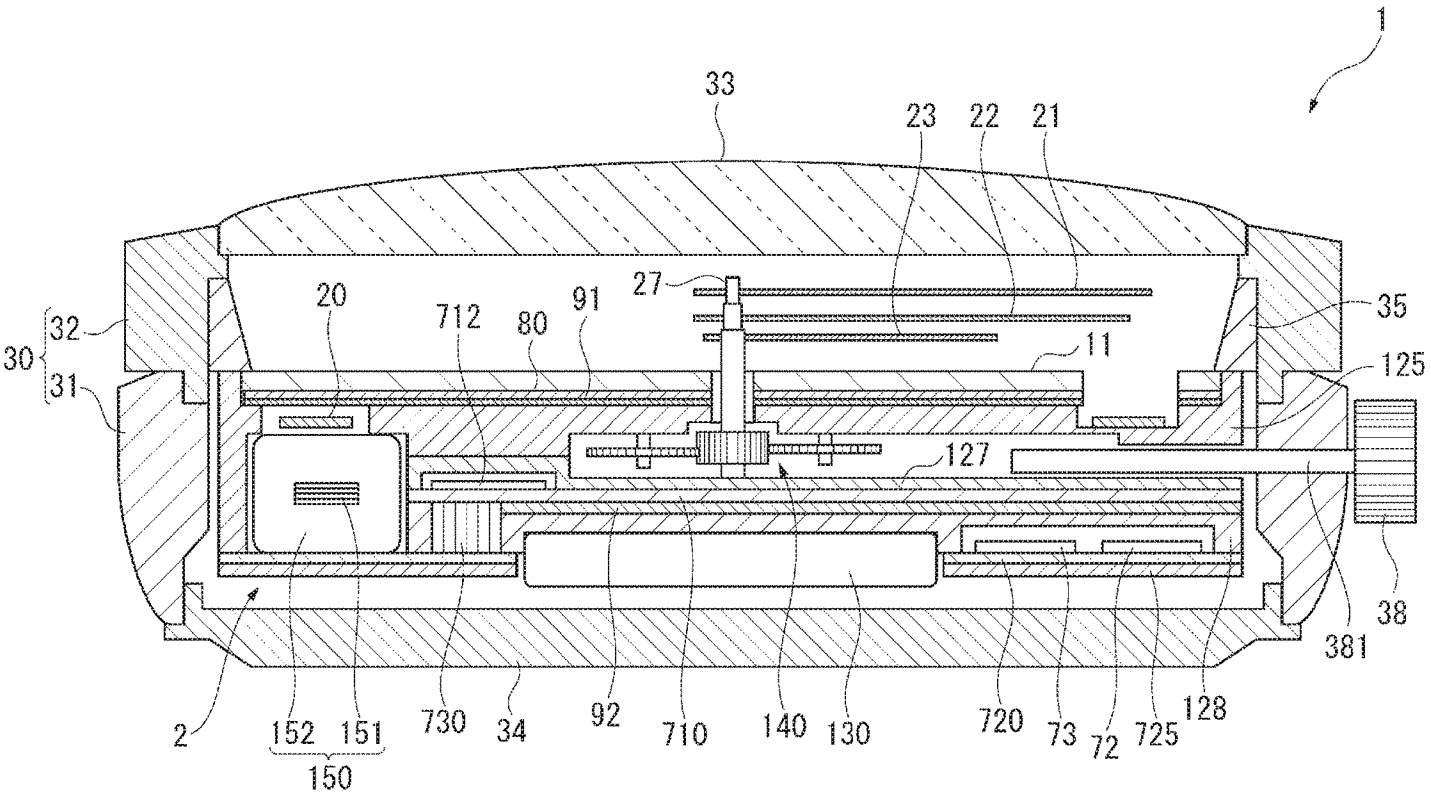
FIG. 4 is a section view of the electronic timepiece.

As shown in FIG. 3 and FIG. 4, the electronic timepiece 1 has an external case 30, crystal 33, and back cover 34. The external case 30 comprises a bezel 32 affixed to a cylindrical case member 31. The external case may also be a single piece combining both the case member and back cover.

Disposed in the side of the external case 30 are a button A 36, a button B 37, and a crown 38.

Of the two main openings in the case member 31, the opening on the face side is covered by the crystal 33 held by the bezel 32, and the opening on the back side is covered by the back cover 34. A round dial 11 is held in place on the inside circumference side of the bezel 32 by a plastic dial ring 35.

The case member 31 and back cover 34 are made of stainless steel, a titanium alloy, aluminum, brass, or other metal. The bezel 32 may also be made from the same metal as the case member 31, but is preferably ceramic so that it does not interfere with signal reception.

A planar antenna (patch antenna) 40 is provided as a satellite signal antenna for receiving GPS satellite signals, and a bar antenna 150 is provided as a standard time signal antenna for receiving long-wave standard time signals. When looking at the electronic timepiece 1 in plan view from the crystal 33 side, the planar antenna 40 is disposed at 12:00 offset from the center of the dial 11, and the bar antenna 150 is disposed at 9:00.

Internal Configuration of the Electronic Timepiece

The internal structure housed in the external case 30 of the electronic timepiece 1 is described next.

As shown in FIG. 3 to FIG. 5, a dial 11 made from a light-transparent material, and a movement 2, are housed inside the external case 30.

Dial

The dial 11 is made from a polycarbonate or other plastic material that is non-conductive and transparent to at least some light, and as shown in FIG. 2 has a first subdial 12 near 6:00 on the dial 11, a second subdial 13 near 10:00 and 11:00 on the dial 11, and a date window 15 through which a date indicator 20 can be seen.

In the plane center of the dial 11 is a through-hole 16 in which the center arbor 27 is disposed, and the second hand 21, minute hand 22, and hour hand 23 for indicating the local time are attached to the center arbor 27. The center arbor 27 thus comprises three pivots (rotational pivots) to which the hands 21, 22, and 23 are disposed.

In the plane center of the first subdial 12 is a through-hole 17 in which another arbor 28 is disposed, and a minute hand 24 and hour hand 25 for indicating the time at a second location (referred to below as the "home time") are attached to the center arbor 28. The arbor 28 thus comprises two pivots (rotational pivots) to which the hands 24 and 25 are disposed.

A through-hole 18 in which another pivot 29 is disposed is also formed in the second subdial 13, and a hand 26 for indicating the of the week and other information is disposed to the pivot 29.

The letters S, M, T, W, T, F, S indicating the days of the week are provided on the right side of the second subdial 13. A "DST" marker indicating the summer time (daylight saving time) mode is set, and a solid dot "." marker indicating that DST is not set, are provided near 7:00 on the left side of the second subdial 13 (the location of 7:00 relative to the pivot 29 of the hand 26). On the left side of the second subdial 13 are provided a sickle-shaped scale for indicating the current power reserve (remaining battery capacity) from 9:00 to 8:00; an airplane icon indicating that an airplane mode is active is provided at 10:00; and at 11:00 are a 1 marker to which the hand 26 points during reception in the timekeeping mode and to indicate that the timekeeping reception process was successful, and a 4+ marker to which the hand 26 points during reception in the positioning mode and to indicate that the positioning reception process was successful.

An information display unit comprising the second subdial 13 and hand 26 therefore switches between indicating the day of the week, the reception mode of the timepiece, and the remaining battery capacity. Button A 36 and button B 37 are used to change the information indicated by the hand 26 between the day of the week and other information.

Dial Ring

A dial ring 35 made of a non-conductive plastic material (such as ABS) is disposed to the face side of the dial 11. The dial ring 35 is disposed around the circumference of the dial 2, is conically shaped in section view with the inside circumference surface sloping down to the dial 11, and has markers for the time and the time zone (time difference to UTC) are printed on the face of the slope. If the dial ring 35 is plastic, good reception performance can be assured, the dial ring 35 can be molded in complicated shapes, and design aesthetics can be improved.

Time difference information indicating the time difference to UTC (Coordinated Universal Time) is denoted by numbers on the face of the bezel 32. Time difference information may also be indicated by numbers and non-numeric symbols. City information denoting the name of a city located in each time zone may also be expressed with the time difference information on the bezel 32. The city information is a three letter code abbreviating the name of the city with three alphabetic letters, such as TYO for Tokyo.

Movement

As shown in FIG. 3 to FIG. 5, the movement 2 comprises, disposed sequentially from the dial 11 to the back cover 34 side, a solar cell panel 80, a first magnetic shield 91, the date indicator 20, main plate 125, drive mechanism 140 (not shown in FIG. 5), wheel train bridge 127 (not shown in FIG. 5), a first circuit board 710, a second magnetic shield 92, a spacer 128 (not shown in FIG. 5), storage battery 130, second circuit board 720, and circuit presser 725 (not shown in FIG. 5).

The planar antenna (patch antenna) 40 and bar antenna 150 are disposed to the second circuit board 720 as described below.

As shown in FIG. 6, the drive mechanism 140 includes stepper motors 141 to 145 disposed to the main plate 125, and wheel trains (not shown in the figure) including wheels axially supported between the main plate 125 and wheel train bridge 127.

The drive mechanism 140 in this embodiment includes first to fifth drive mechanisms. The first drive mechanism includes a first wheel train (not shown in the figure) and a first stepper motor 141 that drives the second hand 21. The second drive mechanism includes a second wheel train (not shown in the figure) and a second stepper motor 142 that drives the minute hand 22 and the hour hand 23. The third drive mechanism includes a third wheel train (not shown in the figure) and third stepper motor 143 that drives the minute hand 24 and hour hand 25 for the home time. The fourth drive mechanism includes a fourth wheel train (not shown in the figure) and a fourth stepper motor 144 that drives hand 26. The fifth drive mechanism includes a fifth wheel train (not shown in the figure) and fifth stepper motor 145 that drives the date indicator 20. The fifth wheel train includes a wheel (day-turning wheel) 146 that meshes with the date indicator 20 shown in FIG. 5 and turns the date indicator 20.

Relative Positions of the Antenna, Battery, and Stepper Motors

As shown in FIG. 6, the planar antenna 40 is located at the 12:00 position of the movement 2 in plan view, and switching mechanisms including the stem 381 and setting lever 382 are disposed at 3:00. A lithium ion battery or other storage battery 130 is located between the center of the movement 2 and the 6:00 position, and the bar antenna 150 is located at the 9:00 position of the movement 2.

As shown in FIG. 3, FIG. 4, and FIG. 6, therefore, the planar antenna 40, bar antenna 150, and storage battery 130 do not overlap each other in plan view inside the external case 30, that is, at mutually non-overlapping positions in the movement 2 when seen in plan view.

As shown in FIG. 6, the stepper motors 141 to 145 are also disposed inside the external case 30 to positions that do no overlap in plan view, that is, at mutually non-overlapping positions in the movement 2 when seen in plan view.

Stepper Motor Locations

All or part of at least some of the stepper motors 141 to 145, specifically motors 141, 143, 145, are disposed superimposed in plan view with the storage battery 130 inside the external case 30.

The first stepper motor 141 is disposed to a position at approximately 8:00 relative to the center arbor 27 in the center of the movement 2 in plan view. In this example, the first stepper motor 141 is between the first subdial 12 and second subdial 13, and is superimposed in plan view with the storage battery 130.

The second stepper motor 142 is disposed to a position at approximately 2:00 from the center arbor 27 in plan view. In this example, the second stepper motor 142 is not superimposed with the planar antenna 40 and storage battery 130 in plan view.

The third stepper motor 143 is disposed to the 6:00 position of the movement 2 in plan view, and is not superimposed with the storage battery 130 in plan view.

The fourth stepper motor 144 is disposed to approximately the 11:00 position of the movement 2 in plan view. In this embodiment, the fourth stepper motor 144 is between the planar antenna 40 and bar antenna 150, and is not superimposed with the antennae 40 and 150 in plan view.

The fifth stepper motor 145 is disposed to the 5:00 position of the movement 2 in plan view, and is disposed to a position superimposed in plan view with the storage battery 130.

Pivot Locations

As shown in FIG. 3, FIG. 4, and FIG. 6, the center arbor 27 in the center of the dial 11 is located above the storage battery 130 at a position superimposed in plan view with the storage battery 130 inside the external case 30.

The arbor 28 of the first subdial 12 is located above the storage battery 130 at a position superimposed in plan view with the storage battery 130.

The pivot 29 of the second subdial 13 is located inside the external case 30 between the planar antenna 40, bar antenna 150, and storage battery 130 at a position not superimposed with these parts in plan view.

In other words, the arbors and pivots 27 to 29 are disposed to positions not superimposed in plan view with the planar antenna 40 and bar antenna 150, and arbors 27, 28 are disposed superimposed in plan view with the storage battery 130.

Circuit Boards

As described above, the electronic timepiece 1 has two circuit boards, a first circuit board 710 for controlling timepiece drive, and a second circuit board 720 for receiving standard time signals and GPS satellite signals. As shown in FIG. 4, the first circuit board 710 and second circuit board 720 are located near 9:00 in plan view, that is, near the bar antenna 150, and are connected through a connector 730.

First Circuit Board

Figure 7:
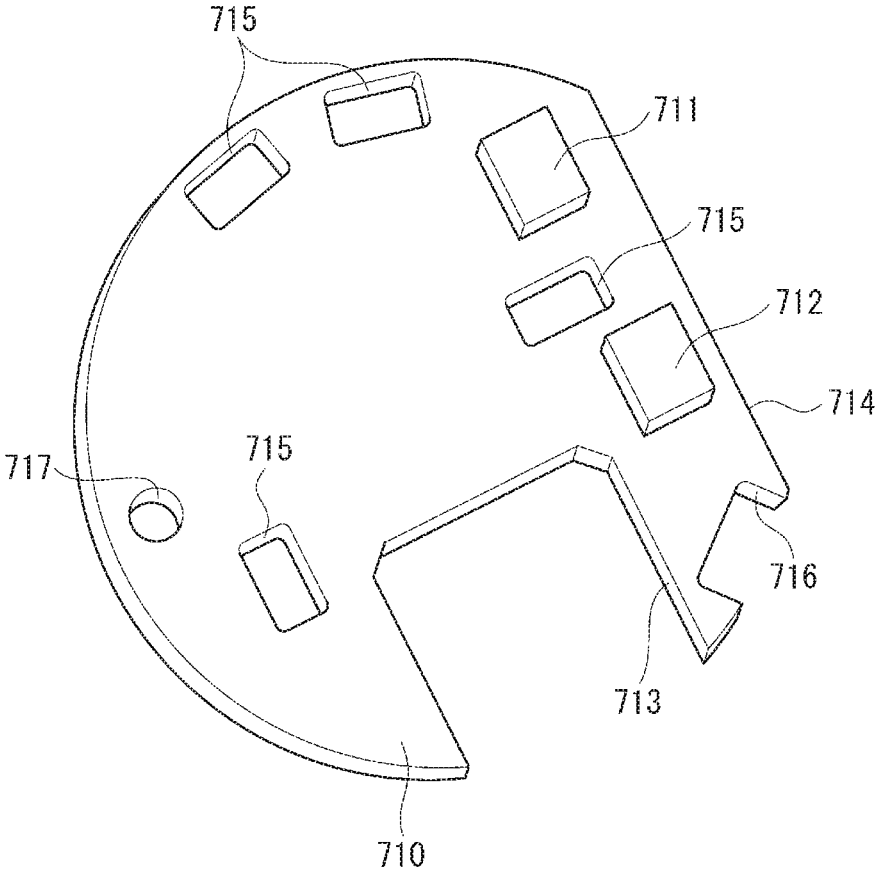
FIG. 7 is an oblique view of the first circuit board in the electronic timepiece.

As shown in FIG. 7, the first circuit board 710 is basically round in plan view, and to prevent wiring lines from interfering with signal reception, has a basically square notch 713 formed in the part superimposed in plan view with the planar antenna 40, and the crescent-shaped segment overlapping the bar antenna 150 in plan view is cut off to form a straight side 714.

A power control chip 711, and a CPU chip 712, the timepiece drive control chip, are mounted on the face side of the first circuit board 710.

To achieve a thin movement 2, holes 715 and a channel 716 are formed in the first circuit board 710 to accommodate the thick motor coils of the stepper motors 141 to 145.

A hole 717 through which a switch contact spring (not shown in the figure) passes is also formed in the first circuit board 710. When the crown 38 is pulled from the 0 stop to the 1 stop or 2 stop, the switch contact spring moves reciprocally in rotation with the rotation of the stem 381, and contacts one of the pair of electrodes formed on the inside circumference surface of the hole 717. As a result, the direction and amount of rotation of the stem 381 by the crown 38 can therefore be detected.

As described below, the power control chip 711 controls charging the storage battery 130 with the solar cell panel 80, and includes a charging control circuit 71 that prevents overcharging and over-discharging, and voltage detection circuit 74 that measures the current or voltage of the solar cell panel 80 and storage battery 130. The voltage detection circuit 74 has ability to detect that the electronic timepiece 1 is outdoors by detecting that the solar cell panel 80 is exposed to strong long light, such as daylight.

Second Circuit Board

Figure 8:
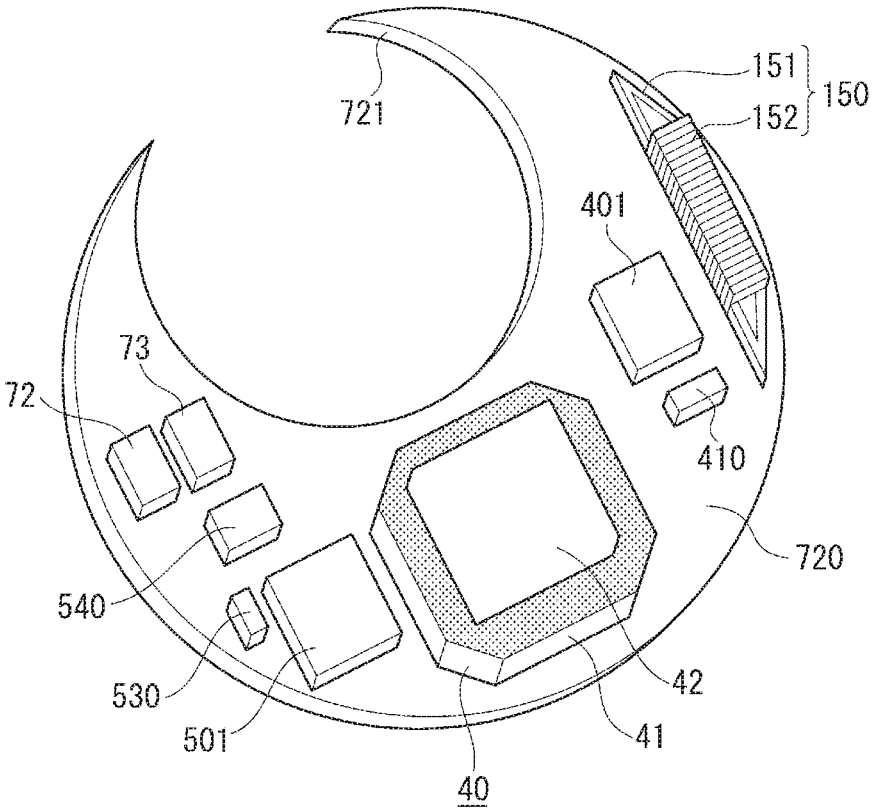
FIG. 8 is an oblique view of the second circuit board in the electronic timepiece.

As shown in FIG. 8, the second circuit board 720 is substantially round in plan view, and has a substantially round notch 721 formed where the storage battery 130 is located. The thickness of the electronic timepiece 1 can be reduced by holding the storage battery 130 in this notch 721.

On the face side of the second circuit board 720 are the planar antenna 40, bar antenna 150, a GPS chip 501 for receiving satellite signals, a temperature-compensated crystal oscillator (TCXO) 530, a memory chip such as flash memory 540, a standard time signal receiver chip 401, a quartz filter 410, a first regulator 72, and a second regulator 73.

As described further below, the GPS chip 501 has an RF unit 510 and a baseband unit 520. The GPS chip 501, TCXO 530, and flash memory 540 configure the GPS receiver 500 described below. The standard time signal receiver chip 401 and quartz filter 410 configure the standard time signal receiver circuit unit 400 described below.

The planar antenna 40 is connected to the GPS chip 501, and the bar antenna 150 is connected to the standard time signal receiver chip 401.

A firmware program for GPS reception, and time zone data for determining the time zone from the location information calculated in the positioning reception process.

Planar Antenna

The planar antenna 40 is for receiving satellite signals from GPS satellites S.

As shown in FIG. 3 and FIG. 5, in plan view, the planar antenna 40 is not superimposed with the external case 30 (case member 31 and bezel 32), solar cell panel 80, first magnetic shield 91, first circuit board 710, and second magnetic shield 92; and is superimposed with the crystal 33, dial 11, date indicator 20, and main plate 125, which are made from non-conductive materials. More specifically, all parts of the electronic timepiece 1 that are over the face side of the planar antenna 40 in plan view are made from non-conductive materials.

As a result, satellite signals passing from the face side of the timepiece pass through the crystal 33, pass through the dial 11, date indicator 20, and main plate 125 and are incident to the planar antenna 40 without interference from the external case 30, solar cell panel 80, first circuit board 710, or magnetic shields 91, 92. Note that the hands 21 to 23, 26 pass over the planar antenna 40 when moving, the area of these hands is small and even if made of metal, the hands do not interfere with receiving satellite signals. However, the hands 21 to 23, 26 are preferably made from a non-conductive material because any interference with signal reception can be avoided.

GPS satellites S transmit right-hand circularly polarized satellite signals. As a result, the planar antenna 40 according to this embodiment is a patch antenna (also called a microstrip antenna) with excellent circular polarization characteristics.

As shown in FIG. 3 and FIG. 8, the planar antenna 40 according to this embodiment is a patch antenna having a conductive antenna electrode 42 formed on a ceramic dielectric substrate 41.

This planar antenna 40 can be manufactured as described below. First, barium titanate with a dielectric constant of 60-100 is formed to the desired shape in a press and sintered to complete the ceramic dielectric substrate 41 of the antenna. A ground electrode forming the ground plane (GND) of the antenna is made by screen printing a primarily silver (Ag) paste, for example, on the back side (the side facing the second circuit board 720) of the dielectric substrate 41.

An antenna electrode 42 that determines the antenna frequency and the polarity of the received signals is formed on the face side of the dielectric substrate 41 (the side facing the main plate 125 and dial 11). The antenna electrode 42 is slightly smaller than the surface of the dielectric substrate 41, and an exposed surface where the antenna electrode 42 is not present is disposed around the antenna electrode 42 on the surface of the dielectric substrate 41.

The surface of the dielectric substrate 41 is substantially square and approximately 11 mm per side. The surface of the antenna electrode 42 is substantially square and approximately 8-9 mm on each side. As shown in FIG. 8, the four corners of the dielectric substrate 41 are cut off at an angle to prevent cracking, but the dielectric substrate 41 may be used without cutting the corners.

The planar antenna 40 is mounted on the second circuit board 720, and is electrically connected to the GPS chip 501 disposed on the face side of the second circuit board 720. The second circuit board 720 can also function as a ground plane by connecting the ground electrode of the planar antenna 40 to the ground pattern of the second circuit board 720.

The case member 31 and back cover 34 can also be used as the ground plane by connecting the ground pattern of the second circuit board 720 through the circuit presser 725 to the case member 31 or back cover 34. As shown in FIG. 3, the back cover conductivity spring 725A for conductivity to the back cover 34 is formed in unison with the circuit presser 725 that holds the second circuit board 720, and the ground pattern of the second circuit board 720 is used as the ground plane by connecting the ground pattern through the circuit presser 725 and back cover conductivity spring 725A to the back cover 34 and case member 31. By using the back cover 34 and case member 31 as the ground plane, the area of the ground plane can be increased, antenna gain can be improved, and antenna characteristics can be improved.

As shown in FIG. 3, the planar antenna 40 is attached to the movement 2 by fastening the second circuit board 720 to the main plate 125. Because the dielectric substrate 41 of the planar antenna 40 is ceramic, hard, and easily chipped, a sponge or other shock absorber 47 intercedes between the dielectric substrate 41 and the main plate 125. As a result, damage to the dielectric substrate 41 from collision with the main plate 125 can be prevented.

Bar Antenna

As shown in FIG. 4 and FIG. 8, the bar antenna 150 for receiving long-wave standard time signals is a bar antenna comprising an antenna core 151 and a coil 152 wound around the antenna core 151.

The antenna core 151 is made by, for example, layering multiple layers of an amorphous cobalt foil as a magnetic foil material on the antenna core 151 to improve magnetic characteristics. The antenna core 151 is manufactured by forming the amorphous metal foil by stamping or etching, for example, and stacking approximately 10 to 30 sheets in the thickness direction of the electronic timepiece 1. Next, the antenna core 151 is placed in a plastic frame forming a channel in cross section, and winding a coil 152 around the antenna core 151 to complete the bar antenna 150.

The antenna core 151 has the coil winding where the coil 152 is wound, and leads extending from the opposite lengthwise ends of the coil winding. The leads are tapered and narrow from the base at the coil winding end to the distal ends of the antenna core 151.

Note that the antenna core 151 is not limited to a stacked amorphous foil configuration, and may be a soft magnetic metal ribbon. Further alternatively, while performance drops, a low cost ferrite antenna core 151 that can be molded with a die and heat treated may be used.

To receive long-wave standard time signals (40-77.5 kHz), the coil 152 wound to the winding part of the antenna core 151 requires inductance of approximately 20-100 mH. As a result, the coil 152 is made by winding several hundred to a thousand and several hundred turns of approximately 50 μm diameter polyurethane enameled copper wire.

The bar antenna 150 thus configured is disposed to the second circuit board 720 at the 9:00 position of the dial 11 in plan view, and is electrically connected to the standard time signal receiver chip 401.

Solar Cell Panel

Figure 9:
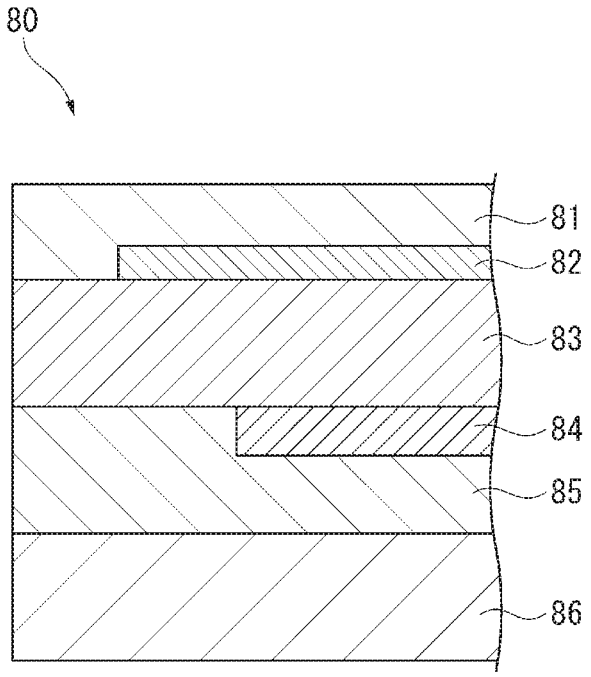
FIG. 9 is a section view showing the laminar structure of the solar battery panel of the electronic timepiece.

As shown in FIG. 9, the solar cell panel 80 comprises sequentially from the face side: a translucent protective face layer 81, a transparent electrode 82 made from a transparent conductive oxide (TCO), an amorphous silicon semiconductor thin-film (a-Si) 83, a back-side electrode 84 of aluminum, a resin base film 85, and a protective back layer 86.

To prevent shorting between the top and bottom electrodes 82, 84 in the 80, the ends of the electrodes 82, 84 are covered by the protective face layer 81 and resin base film 85.

As shown in FIG. 5, a notch 810 is formed in the solar cell panel 80 where the solar cell panel 80 is superimposed with the planar antenna 40 in a plan view of the movement 2, and notch is not formed in the part superimposed with the bar antenna 150. As a result, the electrodes (electrode layers) 82, 84 of the solar cell panel 80 are not superimposed in plan view with the planar antenna 40, and are superimposed in plan view with the bar antenna 150

In other words, because the amorphous silicon semiconductor thin-film 83 is thin and the electrodes 82, 84 are thin with a thickness of only several microns, long-wave standard time signals can pass through the solar cell panel 80 film, and the bar antenna 150 can receive standard time signals even if superimposed in plan view with the electrodes 82, 84.

GPS satellite signals have a high frequency of approximately 1.5 GHz, and unlike long-wave standard time signals GPS satellite signals are attenuated even by the thin electrodes 82, 84 of the solar cell panel 80, and antenna performance drops. As a result, the planar antenna 40 cannot receive GPS satellite signals if it is superimposed with the electrodes 82, 84 in plan view.

As shown in FIG. 5, therefore, the round solar cell panel 80 has a notch 810 formed where the solar cell panel 80 is superimposed with the planar antenna 40 in plan view.

An opening 820 superimposed in plan view with the date window 15 of the dial 11, and through-holes 831, 832, 833 through which pivots 27 to 29 pass, are also formed in the solar cell panel 80.

The solar cell panel 80 is divided into multiple cells, and the cells are connected in series. As shown in FIG. 5, the solar cell panel 80 in this embodiment of the invention has four solar cells connected in series. The positive electrodes and negative electrodes of the solar cell panel 80 are conductive to the positive and negative power supply terminals of the first circuit board 710 through a pair of conductive members 88 such as coil springs disposed in the through-holes of the main plate 125. Charging the storage battery 130 with power produced by the solar cell panel 80 is controlled by the charging control circuit 71 of the power control chip 711.

Because the dial 11 is translucent, the solar cell panel 80 disposed to the back cover side of the dial 11 can be seen from the face side of the timepiece. As a result, the color of the dial 11 is different the areas where the solar cell panel 80 is disposed and where the solar cell panel 80 is not disposed. Design accents may be applied to the dial 11 so that this color difference is not conspicuous.

By forming this notch 810 in the solar cell panel 80, the color tone of the dial 11 in the part overlapping the notch 810 appears different from the color in other parts. To prevent this, a plastic sheet of the same color (such as dark blue or purple) as the solar cell panel 80 may be disposed below the solar cell panel 80, or the signal-blocking electrode layer may be removed only in the part superimposed with the planar antenna 40 in plan view instead of cutting completely through the solar cell panel 80 so that the plastic film base layer remains and the color of the solar panel 25 is the same throughout.

Magnetic Shield

High performance magnets are now commonly used in the cases of smartphones and other mobile devices, and magnetic resistance is also highly desirable in wristwatches. Therefore, as shown in FIG. 3 to FIG. 5, to deflect external magnetic fields and prevent misoperation of the stepper motors 141 to 145, a first magnetic shield 91 and a second magnetic shield 92 made from a high permeability material such as pure iron are disposed to positions superimposed in plan view with the stepper motors 141 to 145. The stepper motors 141 to 145 comprise a coil wound around a core, a stator, and a rotor. Of these, the coil portion is resistant to the effects of external magnetic fields, and does not necessarily need to be superimposed in plan view with the magnetic shields 91, 92. The magnetic shields 91, 92 are therefore superimposed in plan view with at least part of the stepper motors 141 to 145, and are preferably superimposed with the stator and rotor.

As shown in FIG. 3 to FIG. 5, the first magnetic shield 91 is disposed on the face side (crystal 33 side) of the main plate 125 and date indicator 20. The first magnetic shield 91 is disposed to substantially cover the surface (dial 11 side) of the stepper motors 141 to 145.

As shown in FIG. 5, the first magnetic shield 91 has a notch 911 superimposed in plan view with the date window 15 of the dial 11, and through-holes 912, 913, 914 where the pivots 27 to 29 are located.

The first magnetic shield 91 also has a notch 915 removing the portion of the first magnetic shield 91 superimposed in plan view with the planar antenna 40, and an edge 916 formed by removing the portion superimposed in plan view with the bar antenna 150.

As shown in FIG. 3 to FIG. 5, the second magnetic shield 92 is disposed between the side of the main plate 125 facing the back cover (the back cover 34 side), and the crystal (face) side of the second circuit board 720 and storage battery 130. More specifically, the wheel train bridge 127 that supports the bearings of the wheel trains is disposed on the back cover side of the main plate 125, and the second magnetic shield 92 is disposed on the back cover side of the wheel train bridge 127. As a result, the second magnetic shield 92 is disposed substantially covering the back sides (the sides facing the back cover 34) of the stepper motors 141 to 145.

The portion of the second magnetic shield 92 is also cut out in the area superimposed in plan view with the planar antenna 40, forming a notch 925; and the portion superimposed in plan view with the bar antenna 150 is also cut off, forming an edge 926.

The first magnetic shield 91 and second magnetic shield 92 are thus formed to not be superimposed in plan view with the planar antenna 40 and bar antenna 150.

Date Indicator

A round date indicator 20 having date numbers displayed on the face side thereof is also disposed to the main plate 125. The date indicator 20 is made from plastic or other non-conductive material. The date indicator 20 is superimposed in plan view with at least part of the planar antenna 40 and bar antenna 150. The date indicator 20 is not limited to indicating the date, and may be a day wheel indicating the day of the week, or a month wheel indicating the month.

Storage Battery

As shown in FIG. 3 to FIG. 6, the storage battery 130 is a lithium ion button battery. The storage battery 130 supplies power to the drive mechanism 140, standard time signal receiver circuit unit 400, and GPS receiver 500. The storage battery is disposed in the notch 721 of the second circuit board 720, and as described above is disposed not superimposed in plan view with the planar antenna 40 and bar antenna 150. The storage battery 130 is disposed superimposed in plan view with a portion of the stepper motors 141, 143, 145 and wheel trains.

The storage battery 130 in this embodiment must supply a current of 10 mA or greater to receive satellite signals, and requires a capacity of several ten mAh. As a result, in this embodiment, a lithium ion button battery approximately 20 mm in diameter (a dimension greater than the radius of the dial 11 in this embodiment) is used as the storage battery 130.

The storage battery 130 is therefore thinner (the dimension in the thickness direction of the timepiece) than the diameter of the storage battery 130 (the dimension parallel to the back cover 34), flat, and disposed in the notch 721 of the second circuit board 720. A thin electronic timepiece 1 can therefore be achieved even if the storage battery 130 is superimposed in plan view with parts of the stepper motors 141, 143, 145 and wheel trains.

Circuit Design of the Electronic Timepiece

Figure 10:
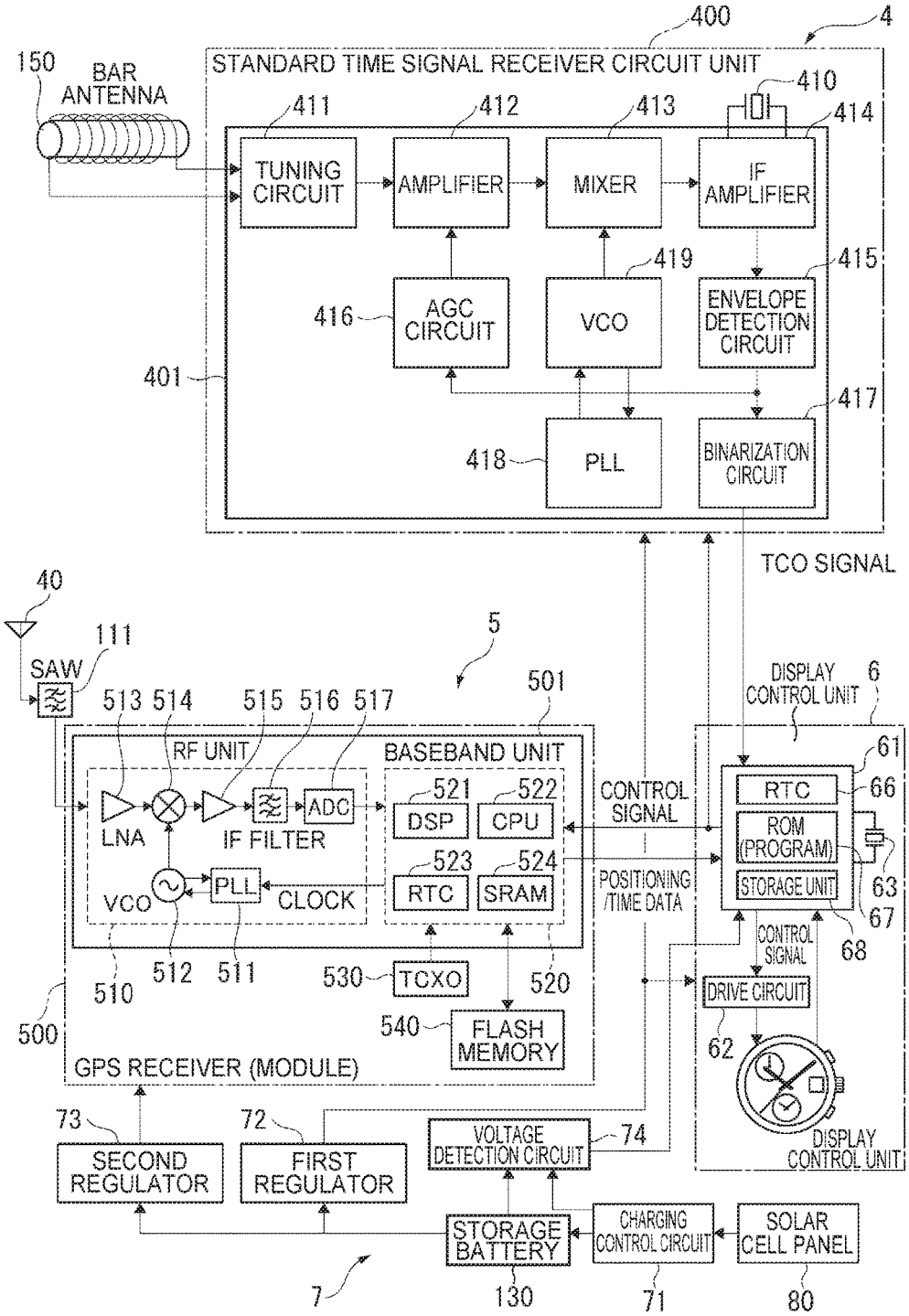
FIG. 10 is a block diagram showing the circuit configuration of the electronic timepiece

FIG. 10 shows the basic circuit configuration of the electronic timepiece 1.

The main components of the electronic timepiece 1 include a standard time signal receiver 4 that receives long-wave standard time signal and acquires time information; a satellite signal receiver 5 that receives satellite signals and acquires time information; a display control unit 6; and a power supply unit 7.

Figure 11:
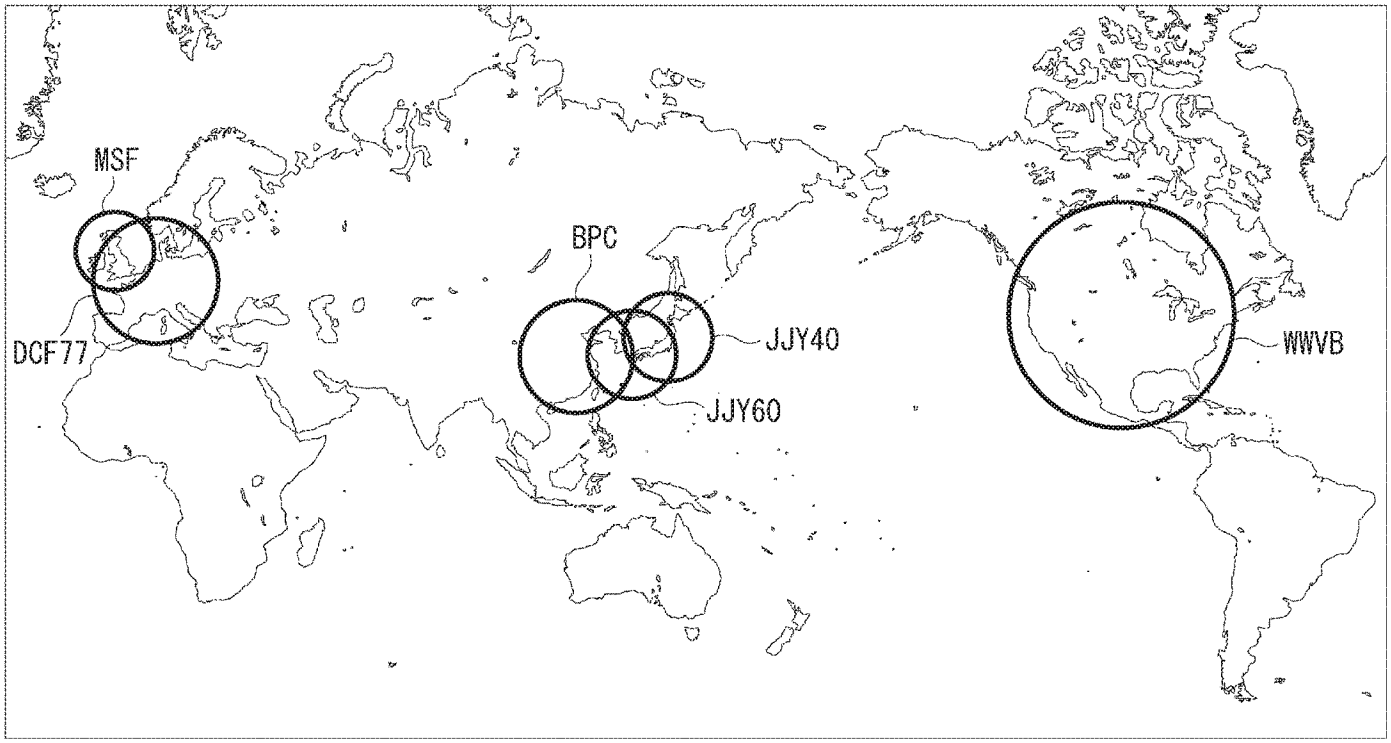
FIG. 11 illustrates standard time signal reception areas.

As shown in FIG. 11, long-wave standard time signals can only be received in specific areas of the world. More specifically, JJY40 and JJY60 can be received in areas centered on Japan; BPC can be received in an area centered on China; WWVB in an area centered on the United States; MSF in an area centered on Great Britain; and DVF77 in an area centered on Germany.

GPS satellite signals, however, can be received in an area significantly larger than the reception areas for long-wave standard time signals, that is, anywhere in the world.

Information related to the reception areas where long-wave standard time signals can be received is stored in the storage unit 68 described below.

Time Code Format of Long-Wave Standard Time Signals

The time information (time code) of a long-wave standard time signal is configured based on the time information format (time code format) specific to each country.

Figure 12:
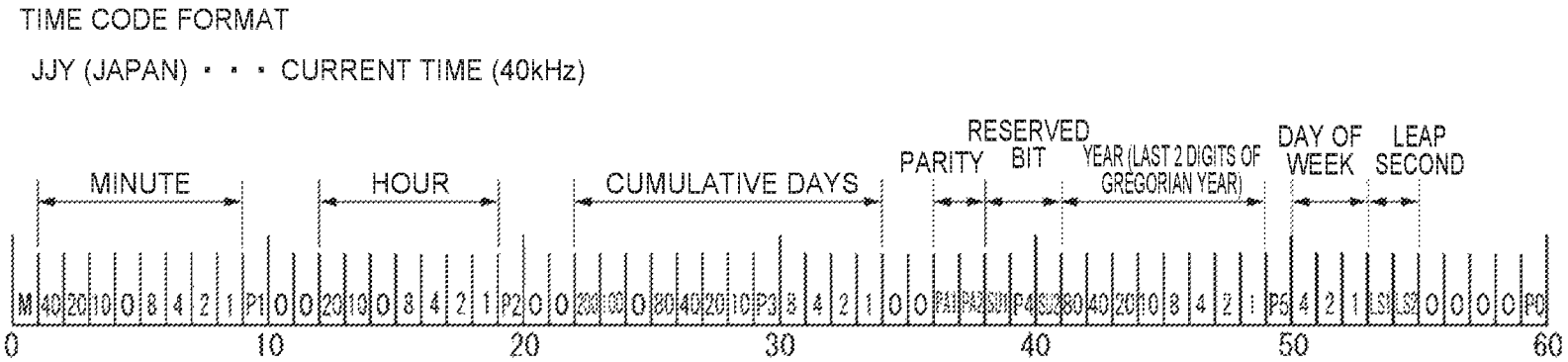
FIG. 12 shows the time code format of the JJY standard time signal.

For example, with the time code format of the JJY signal transmitted in Japan as shown in FIG. 12, one signal is transmitted each second, and it takes 60 seconds to transmit one record (one frame). In other words, one frame comprises 60 bits of data. The data fields contained in this time code format include the minute and hour of the current time, the cumulative number of days since January 1 of the current year, the year (denoted by the last two digits of the Gregorian calendar year), the day of the week, and the leap seconds. The value for each field is determined by combining the value assigned to each second (each bit), and the combination is determined from the type of signal. A parity bit PA1 corresponding to the hour, and a parity bit PA2 corresponding to the minute, are inserted between the bit train of the cumulative number of days and the bit train for the year. Note that M in FIG. 12 denotes the minute (0 second of each minute), and P1 to P5 are position marker signals, the positions of which are predefined.

The signal denoting a 1 in each field is a signal with a pulse width of approximately 0.5 second, signals denoting a 0 are signals with a pulse width of approximately 0.8 second, and the P signals denoting the markers are signals with a pulse width of approximately 0.2 second.

The time code format of the standard time signal and the pulse widths (duty) of the various signals are set according to the type of long-wave standard time signal.

Navigation Data Message of the Satellite Signal

Figure 13:
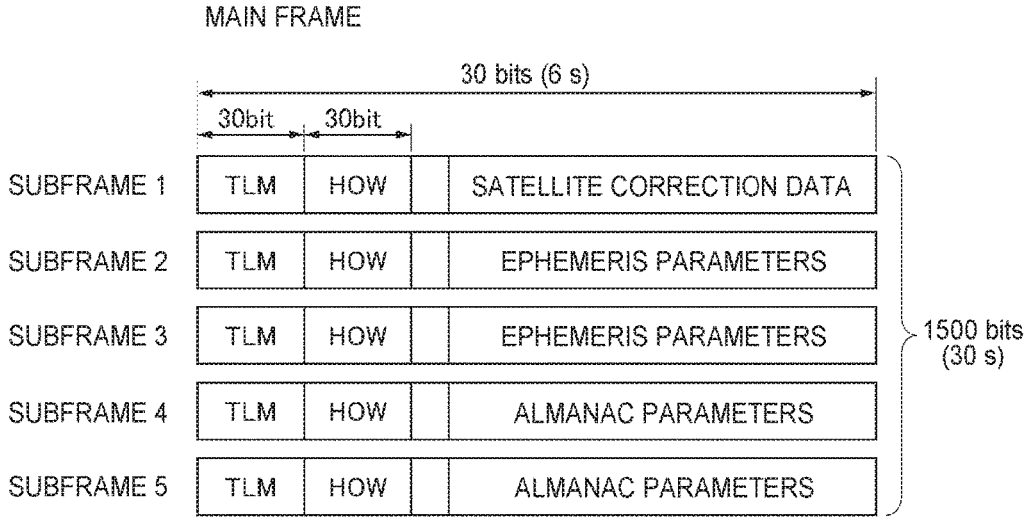
FIG. 13 describes the format of the navigation message of a GPS satellite signal.
Figure 14:
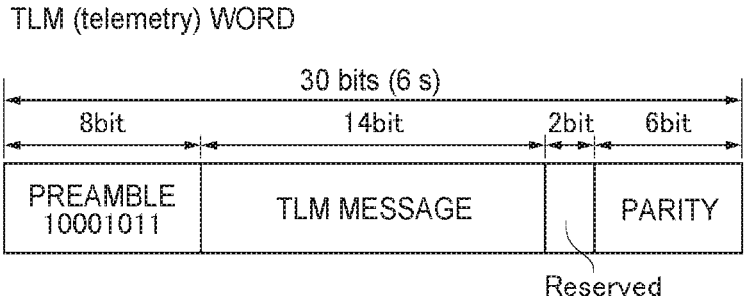
FIG. 14 illustrates the format of the TLM word of a GPS satellite signal.
Figure 15:
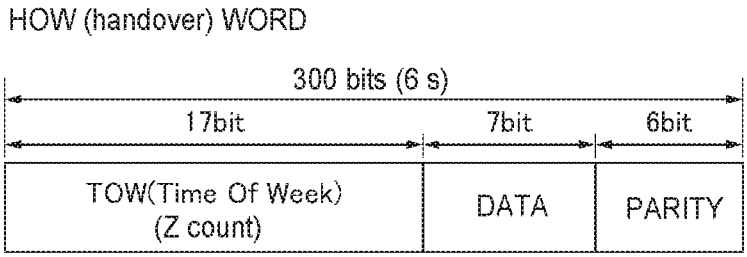
FIG. 15 illustrates the format of the HOW word of a GPS satellite signal.

FIG. 13 to FIG. 15 describe the format of the navigation data message.

As shown in FIG. 13, a navigation data message is composed of main frames each containing 1500 bits. Each main frame is divided into five subframes 1 to 5 of 300 bits each. The data in one subframe is transmitted in 6 seconds from each GPS satellite. It therefore takes 30 seconds for the data in one main frame to be transmitted from a GPS satellite.

Subframe 1 contains satellite correction data including week number data and SV health information. The week number identifies the week of the current GPS time information. More specifically, GPS time started at 00:00:00 on Jan. 6, 1980 in UTC, and the week number of the week that started that day is week number 0. The week number is updated every week. The SV health information is a code indicating satellite errors, and this code can be used to prevent using signals transmitted from satellites where there is an error.

Because subframes 1 to 3 in each set of five subframes contains information specific to a particular satellite, the same content is repeated during every transmission. More specifically, subframes 1 to 3 contain clock correction data and orbit information (ephemeris) specific to the transmitting satellite. Subframes 4 and 5, however, contain orbit information for all satellites (almanac data) and ionospheric correction information, which because of the large amount of information is divided into page units and stored in subframes 4 and 5 over pages 1 to 25. Because 25 frames are required to transmit the content of all pages, 12 minutes 30 seconds is required to receive all of the information in the navigation data message.

Each of subframes 1 to 5 starts with a telemetry (TLM) word storing 30 bits of telemetry data followed by a HOW word (handover word) storing 30 bits of handover data.

Therefore, while the TLM and HOW words are transmitted at 6-second intervals from the GPS satellites, the week number data and other satellite correction data, ephemeris, and almanac data are transmitted at 30-second intervals.

As shown in FIG. 14, the TLM word contains a preamble, a TLM message and reserved bits, and parity data.

As shown in FIG. 15, the HOW word contains GPS time information called the TOW or Time of Week (also called the Z count). The Z count denotes in seconds the time passed since 00:00 of Sunday each week, and is reset to 0 at 00:00 Sunday the next week. More specifically, the Z count denotes the time passed from the beginning of each week in seconds. The Z count denotes the GPS time at which the first bit of the next subframe data is transmitted.

For example, the Z count transmitted in subframe 1 denotes the GPS time that the first bit in subframe 2 is transmitted. The HOW word also contains 3 bits of data denoting the subframe ID (ID code). More specifically, the HOW words of subframes 1 to 5 shown in FIG. 13 contain the ID codes 001, 010, 011, 100, and 101, respectively.

Standard Time Signal Receiver

As shown in FIG. 10, the standard time signal receiver 4 includes the bar antenna 150 and standard time signal receiver circuit unit 400. The bar antenna 150 receives long-wave standard time signals (referred to below as a standard time signal), and outputs the received standard time signal to the standard time signal receiver circuit unit 400. The standard time signal receiver circuit unit 400 demodulates the standard time signal received by the bar antenna 150, and outputs the demodulated signal as a TCO (Time Code Output) signal to the controller 61 of the display control unit 6.

The standard time signal receiver circuit unit 400 comprises a standard time signal receiver chip 401 and a quartz filter 410. The standard time signal receiver chip 401 comprises a tuning circuit 411, amplifier 412, mixer 413, an IF (intermediate frequency) amplifier 414 using the quartz filter 410, an envelope detection circuit 415, an AGC (Auto Gain Control) circuit 416, a binarization circuit 417, a PLL (phase locked loop) 418, and a VCO (Voltage Controlled Oscillator) 419. The standard time signal receiver circuit unit 400 is a common circuit for receiving standard time signals.

The tuning circuit 411 comprises a capacitor, and a parallel resonance circuit is embodied by the tuning circuit 411 and bar antenna 150. This tuning circuit 411 is configured so that JJY (JJY40 and JJY60), WWVB, DCF77, MSF, and BPC standard time signals can be selectively received.

Note that as described further below, when positioning information (latitude and longitude) for the electronic timepiece 1 is acquired by the satellite signal receiver 5, the controller 61 outputs a selection signal for the receiver station based on the positioning information to the standard time signal receiver circuit unit 400. The tuning circuit 411 of the standard time signal receiver circuit unit 400 then automatically selects the receiver station based on the control (selection) signal.

When positioning information for the electronic timepiece 1 has not been acquired by the satellite signal receiver 5, the appropriate receiver station can be selected by the user manipulating the crown 38 or other operating member to select the current time zone (time difference).

The amplifier 412 adjusts the gain according to the signal (AGC voltage) input from the AGC circuit 416, and amplifies the reception signal input from the tuning circuit 411 to a specific amplitude, and inputs the amplified signal to the mixer 413.

The mixer 413 mixes the reception signal with a signal from the VCO 419, and down-converts to an intermediate frequency (IF).

The IF amplifier 414 further amplifies the reception signal input from the mixer 413, and outputs to the envelope detection circuit 415.

The envelope detection circuit 415 comprises a rectifier not shown and a low-pass filter (LPF) not shown, rectifies and filters the input reception signal, and outputs the filtered envelope signal to the AGC circuit 416 and binarization circuit 417.

Based on the envelope signal input from the envelope detection circuit 415, the AGC circuit 416 outputs a signal determining the gain used by the amplifier 412 to amplify the reception signal.

The binarization circuit 417 compares the envelope signal input from the envelope detection circuit 415 with a reference signal (threshold), and outputs a binarized signal, that is, a TCO signal.

Satellite Signal Receiver

The satellite signal receiver 5 includes the planar antenna 40, a filter (SAW) 111, and the GPS receiver 500 (reception module).

The SAW filter 111 is a bandpass filter that passes signals in the 1.5 GHz waveband. A LNA (low noise amplifier) may also be disposed between the ring antenna 110 and the filter 111 to improve reception sensitivity. Note also that the filter 111 may be embedded in the GPS receiver 500.

The GPS receiver 500 is for processing satellite signals that pass the filter 111, and comprises the GPS chip 501 for satellite signal reception, the TCXO 530, and flash memory 540.

The GPS chip 501 comprises an RF (radio frequency) unit 510 and a baseband unit 520.

The RF unit 510 includes a PLL circuit 511, a VCO (voltage controlled oscillator) 512, a LNA (low noise amplifier) 513, a mixer 514, an IF amplifier 515, an IF filter 516, and an A/D converter 517.

A satellite signal passed by the filter 111 is amplified by the LNA 513, then mixed by the mixer 514 with the signal output by the VCO 512, and down-converted to a signal in the intermediate frequency band.

The IF signal from the mixer 514 is amplified by the IF amplifier 515, passed through the IF filter 516, and converted to a digital signal by the A/D converter 517.

The baseband unit 520 includes a DSP (digital signal processor) 521, CPU (central processing unit) 522, a RTC (real-time clock) 523, and SRAM (static random access memory) 524. A TCXO (temperature compensated crystal oscillator) 530 and flash memory 540 are also connected to the baseband unit 520.

A digital signal is input from the A/D converter 517 of the RF unit 510 to the baseband unit 520, which acquires satellite time information and navigation information by a correlation process and location computing process.

Note that the clock signal for the PLL circuit 511 is generated by the TCXO 530.

A time difference (time zone) database relating location information (latitude and longitude) to time difference (time zone) information is stored in flash memory 540. Therefore, if the location can be calculated by receiving satellite signals, the time difference (time zone) at the received location can be detected and set based on the latitude and longitude data and the time difference database. Note that an EEPROM (electrically erasable programmable read-only memory) device may be used instead of flash memory 540.

Note that while the time zone database is stored in the flash memory 540 of the GPS receiver 500 in this embodiment of the invention, nonvolatile memory such as EEPROM or flash memory may be provided in the controller 61 of the display control unit 6, and the time difference database stored in this nonvolatile memory device.

Display Control Unit

The display control unit 6 includes a controller (CPU) 61, a drive circuit 62 that drives the hands 21-26, a crystal oscillator 63, a time display unit, and an information display unit.

The controller 61 includes a RTC 66, ROM 67, and storage unit 68.

The RTC 66 keeps the internal time using a reference signal output from the crystal oscillator 63. ROM 67 stores programs that are run by the controller 61.

The storage unit 68 stores the satellite time information and positioning information output from the GPS receiver 500, and the TCO (time information of the standard time signal) output from the standard time signal receiver circuit unit 400.

The controller 61 switches between the standard time signal receiver 4 and satellite signal receiver 5 by outputting control signals to the standard time signal receiver 4 and satellite signal receiver 5. Compared with standard time signals, GPS satellite signals have a higher frequency at approximately 1.5 GHz, and reception signal strength is approximately 1/100. As a result, the GPS satellite signal reception process of the satellite signal receiver 5 requires approximately 500 times as much power as the standard time signal reception process of the standard time signal receiver 4.

The controller 61 therefore switches between the standard time signal receiver 4 and satellite signal receiver 5 instead of driving them simultaneously.

By having a standard time signal receiver 4, satellite signal receiver 5, and display control unit 6 as described above, the electronic timepiece 1 according to this embodiment can automatically correct the time information based on the standard time signal received from a standard time signal transmitter R, and can automatically correct the displayed time based on the satellite signals from the GPS satellites S.

Power Supply Unit

The power supply unit 7 includes the solar cell panel 80, a charging control circuit 71, the storage battery 130, a first regulator 72, a second regulator 73, and a voltage detection circuit 74.

When light is incident and the solar cell panel 80 produces power, the power obtained by photovoltaic generation is passed by the charging control circuit 71 to the storage battery 130 to charge the storage battery 130.

The storage battery 130 supplies drive power through the first regulator 72 to the display control unit 6 and the standard time signal receiver circuit unit 400, and supplies power through the second regulator 73 to the GPS receiver 500. The storage battery 130 therefore embodies a power supply means that supplies drive power.

The voltage detection circuit 74 monitors the output voltage of the storage battery 130, and outputs to the controller 61. The voltage detection circuit 74 therefore embodies a reserve power detection means that detects how much power remains in the storage battery 130 embodying the power supply means. Because the battery voltage detected by the voltage detection circuit 74 is input to the controller 61, the controller 61 can know the voltage of the storage battery 130 and control the reception process appropriately.

When the solar cell panel 80 and storage battery 130 are disconnected as controlled by the controller 61, the charging control circuit 71 can control detecting the voltage of the solar cell panel 80 by the voltage detection circuit 74. In this event, the voltage detection circuit 74 can detect the output voltage (power output) of the solar cell panel 80 without being affected by the voltage of the storage battery 130. The voltage detection circuit 74 therefore embodies a power generation detection unit that detects the power output of the solar cell panel 80, and inputs the detected power output to the controller 61. As a result, the controller 61 can determine whether or not the electronic timepiece 1 is outdoors based on the power output of the solar cell panel 80.

Controller Configuration

Figure 16:
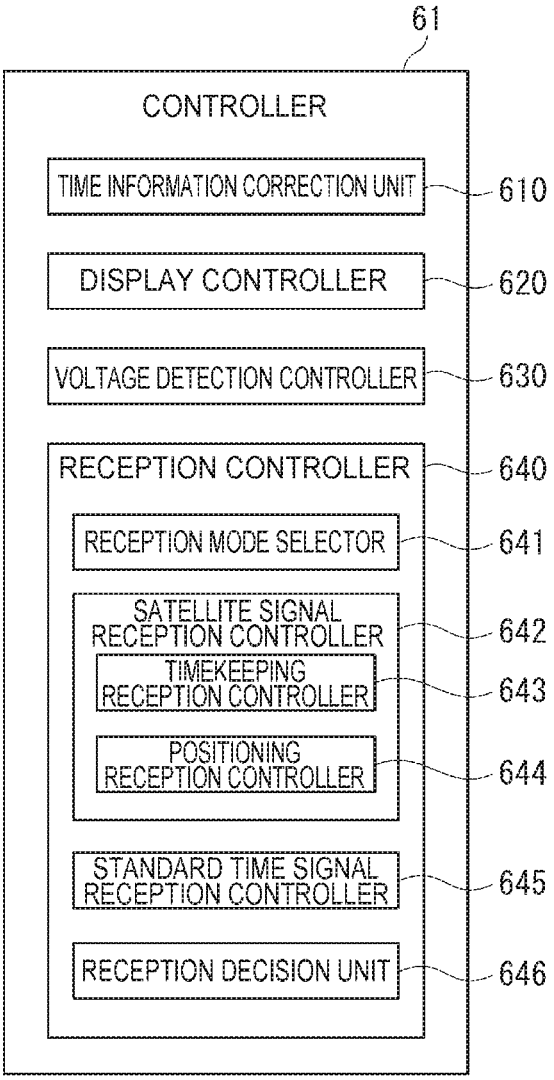
FIG. 16 is a block diagram showing the functional configuration of the controller of the electronic timepiece.

The configuration of the controller 61 is described next with reference to FIG. 16. FIG. 16 illustrates the function blocks that are embodied by a program executed by the controller 61.

The controller 61 includes a time information correction unit 610, display controller 620, voltage detection controller 630, and a reception controller 640.

The time information correction unit 610 corrects the internal time information using the time information received by the standard time signal receiver 4 or satellite signal receiver 5.

In the normal operating mode, the display controller 620 controls the drive circuit 62 based on the internal time information to display the local time (hour, minute, second) with hands 21 to 23, and display the hour and minute of the home time (second time) with hands 24, 25. The display controller 620 also controls the drive circuit 62 based on the internal time information to indicate the day of the week (Sunday to Saturday) with hand 26. The display controller 620 also controls the information indicated by hand 26 appropriately to the reception control mode.

The voltage detection controller 630 operates the voltage detection circuit 74 to detect the voltage, that is, the remaining battery capacity, of the storage battery 130, and the power output of the solar cell panel 80. The voltage detection controller 630 operates the voltage detection circuit 74 and detects the battery voltage at a specific time interval. The voltage detection controller 630 also controls operation of the charging control circuit 71.

Reception Controller

The reception controller 640 includes a reception mode selector 641, a satellite signal reception controller 642, a standard time signal reception controller 645, and a reception decision unit 646. The satellite signal reception controller 642 includes a timekeeping reception controller 643, and a positioning reception controller 644.

The reception mode selector 641 determines if button A 36 was operated to start reception, or if a predetermined automatic reception condition was met, and selects the satellite signal reception mode (timekeeping mode or positioning mode) or the standard time signal reception mode. The reception mode selector 641 selects the timekeeping mode if button A 36 is pressed for a first specific time (such as 3 or more and less than 6 seconds), and selects the positioning mode if button A 36 is pressed for a second specific time (such as 6 seconds or more). If the voltage detection circuit 74 detects that the electronic timepiece 1 is outdoors and an automatic reception condition is met, the reception mode selector 641 normally selects the timekeeping mode, and selects the positioning mode only once after the reception-off mode of the electronic timepiece 1 is cancelled.

The satellite signal reception controller 642 is operated when the satellite signal reception mode is selected by the reception mode selector 641.

If the timekeeping mode is selected, the satellite signal reception controller 642 operates the timekeeping reception controller 643, and the timekeeping reception controller 643 controls the satellite signal receiver 5 to execute the timekeeping reception process.

If the positioning mode is selected, the satellite signal reception controller 642 operates the positioning reception controller 644, and the positioning reception controller 644 controls the satellite signal receiver 5 to execute the positioning reception process.

The standard time signal reception controller 645 is operated when the standard time signal reception mode is selected by the reception mode selector 641. The standard time signal reception controller 645 controls the standard time signal receiver 4 to execute the standard time signal reception process.

The reception decision unit 646 determines if the timekeeping reception process of the timekeeping reception controller 643, the positioning reception process of the positioning reception controller 644, or the standard time signal reception process of the standard time signal reception controller 645 was successful.

For example, in the timekeeping reception process, the reception decision unit 646 compares the time information (Z count) acquired from the received satellite signal and the time data of the RTC 66 match. If the difference therebetween is great, the reception decision unit 646 may compare the Z count with the Z count received in the next subframe to prevent correction errors, and if multiple satellites are locked onto, the reception decision unit 646 may compare the Z counts from the plural satellites to determine if the acquired time data matches. If the reception decision unit 646 determines the times match, the time information correction unit 610 corrects the time.

Automatic Reception Process

The automatic reception process, which is a reception process executed when a predetermined automatic reception condition is met, in this embodiment of the invention is described next with reference to FIG. 17 to FIG. 20.

Figure 17:
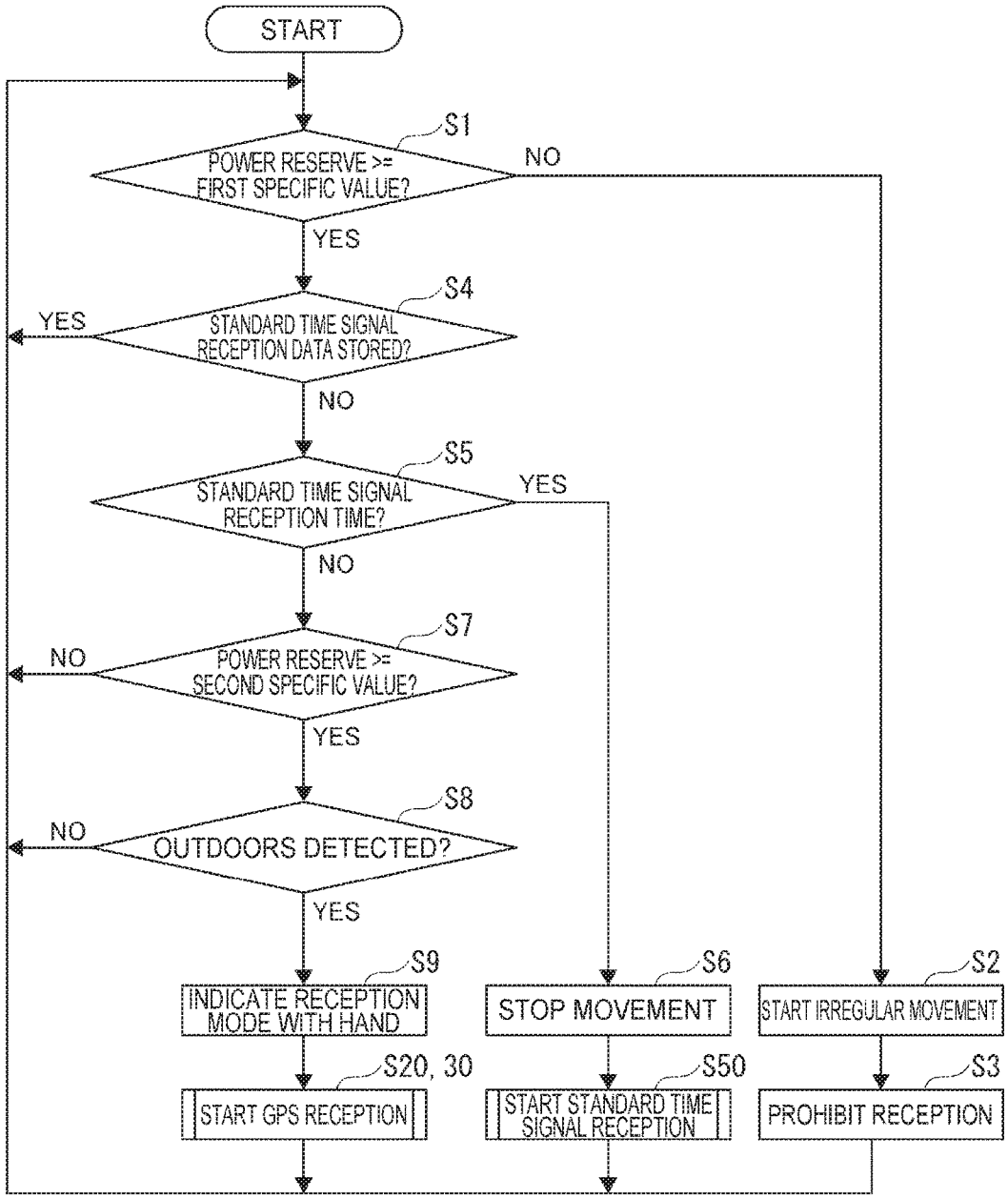
FIG. 17 is a flow chart of the automated reception process in this embodiment of the invention.

When the electronic timepiece 1 is not set to a mode that blocks executing the automatic reception process, such as an airplane mode, the controller 61 executes the process shown in FIG. 17. The automatic reception process in FIG. 17 executes at a previously set time, such as 2:00 a.m. when there is little noise interfering with standard time signal reception.

The voltage detection circuit 74 operates as controlled by the voltage detection controller 630 at a specific interval, such as every 60 seconds in this example. Because the voltage detection circuit 74 detects the battery voltage of the storage battery 130 at a 60-second interval, the controller 61 always knows the remaining capacity of the storage battery 130.

The voltage detection controller 630 sets the battery voltage of the storage battery 130 at which the controller 61 may shut down if the standard time signal reception process, which consumes less current than the GPS satellite signal reception process, is executed as a first specific value. The voltage detection controller 630 also sets the voltage at which the controller 61 will not shut down if the timekeeping reception process of GPS satellite signals, which consumes more current than the standard time signal reception process, is executed as a second specific value. Note that the second specific value is normally set to a voltage at which the controller 61 will not shut down even if the positioning reception process executes, and is a voltage higher than the first specific value. For example, the first specific value is set to 3.4 V, the second specific value is set to 3.6 V, and these values are set based on the discharge characteristics of the storage battery 130.

Note that this embodiment of the invention detects the power reserve of the storage battery 130 by detecting the battery voltage of the storage battery 130, but the remaining battery capacity may be detected more accurately by adding a means of detecting the charge/discharge current of the storage battery 130, and using a combination of the charge/discharge current and the battery voltage to decide.

The controller 61 detects the battery voltage of the storage battery 130 every 60 seconds by means of the voltage detection circuit 74, which is a reserve power detection unit, and determines if the battery voltage is greater than or equal to the previously set first specific value (S1).

If the battery voltage is less than the first specific value and S1 returns NO, the controller 61 starts irregular movement of the hands by the drive circuit 62 (S2), and maintains a reception-prohibited state (S3). This irregular movement (or BLD movement) drives the hands in a mode different from the normal timekeeping mode, such as advancing the second hand 21 in 2-second increments every two seconds, in what is also referred to as a Battery Low display (BLD) or battery life indicator function. This enables the user to know that the voltage of the storage battery 130 is low and expose the solar cell panel 80 to light to charge the storage battery 130.

During irregular movement of the hands, the controller 61 repeats step S1 to check the battery voltage with the voltage detection circuit 74 at a regular interval, such as a 1-second interval. The controller 61 then repeats the irregular movement of step S2 and the reception-prohibited state of step S3 until S1 returns YES.

If the battery voltage is greater than or equal to the first specific value and S1 returns YES, the controller 61 determines if standard time signal reception was successful and standard time signal reception data was stored during the last scheduled reception process (such as within the last 24 hours), or if reception failed and data is not stored (S4). More specifically, the controller 61 returns NO in S4 if standard time signal reception data is stored but was acquired more than 24 hours earlier, and returns YES if the data was stored within the last 24 hours.

If S4 returns YES, there is no need to receive GPS satellite signals and the controller 61 returns to step S1. As a result, as described below, if a standard time signal was received and time information was successfully acquired at the scheduled standard time signal reception time of 2:00 a.m., for example, the GPS satellite signal reception process does not execute until the scheduled standard time signal reception time the next day. Therefore, if the standard time signal is received and time information acquisition is successful at the scheduled standard time signal reception time every day, the standard time signal reception process is prioritized and the GPS satellite signal reception process is not executed.

However, if at the scheduled standard time signal reception time the standard time signal reception process was not executed, or if the reception process executed but receiving a standard time signal failed or if the time information was received but acquisition of time information failed, that is, if acquisition of time information by receiving a standard time signal failed and standard time signal reception data is not stored, the controller 61 returns NO in S4 and goes to step S5.

If NO is returned in S4, the controller 61 determines if the internal time (current time) kept by the controller 61 has reached the previously set scheduled standard time signal reception time (S5). The scheduled standard time signal reception time is set to a time when there is little noise, such as 2:00 a.m. Plural scheduled standard time signal reception times may also be set, such as at 2:00, 3:00, and 4:00 a.m. In this event, if the reception process fails at 2:00 a.m., the reception process may repeat at 3:00 a.m., and if the reception process fails at 3:00 a.m., the reception process may repeat at 4:00 a.m.

If the internal time has reached a scheduled standard time signal reception time, the controller 61 returns YES in S5. In this event, the controller 61 stops movement of the hands 21-26 by the drive circuit 62 (S6). That standard time signal reception is in progress may be displayed in this event by hand 26.

Next, the controller 61 starts the standard time signal reception process (S50). This standard time signal reception process is described further below.

If a scheduled reception time has not been reached (S5 returned NO), the controller 61 determines if the battery voltage detected by the voltage detection circuit 74 is greater than or equal to the second specific value (S7).

If S7 returns YES, the controller 61 determines if outdoor detection is successful (S8). Outdoor detection determines if the solar cell panel 80 is exposed to sunlight. More specifically, the power output of the solar cell panel 80 is used to determine if the electronic timepiece 1 is outdoors, and determines the electronic timepiece 1 is outdoors if the solar cell panel 80 is exposed to strong light of approximately 10,000 lux or more. As a result, the controller 61 regularly controls the charging control circuit 71 to interrupt the charging path between the solar cell panel 80 and storage battery 130, then detects the voltage of the solar cell panel 80 with the voltage detection circuit 74, and detects being outdoors if the voltage of the solar cell panel 80 is greater than or equal to a specific voltage. Note that if the internal time indicates night time (such as from 21:00 to 5:00), the controller 61 may skip the process of detecting an outdoors location and block the GPS satellite signal reception process. This is because strong light such as sunlight cannot be received at night, and detecting whether or not the electronic timepiece 1 is outdoors is not possible.

If NO is returned in step S7 or S8, the controller 61 returns to S1. If step S7 or S8 each return YES, the controller 61 moves hand 26 to the 1 marker, or to the 4+ marker if the positioning mode was selected immediately after cancelling the airplane mode, to indicate that GPS satellite signals are being received (S9).

Next, the controller 61 starts the GPS satellite signal reception process (S20, S30). More specifically, if the battery voltage is greater than or equal to the second specific value (3.6 V), and outdoor detection was successful, the controller 61 normally executes the timekeeping reception process (S20), and executes the positioning reception process (S30) only once after the airplane mode is cancelled.

As a result, if daily standard time signal reception failed, the GPS satellite signal reception process executes as a result of the conditions of steps S7 and S8.

Timekeeping Reception Process

Figure 18:
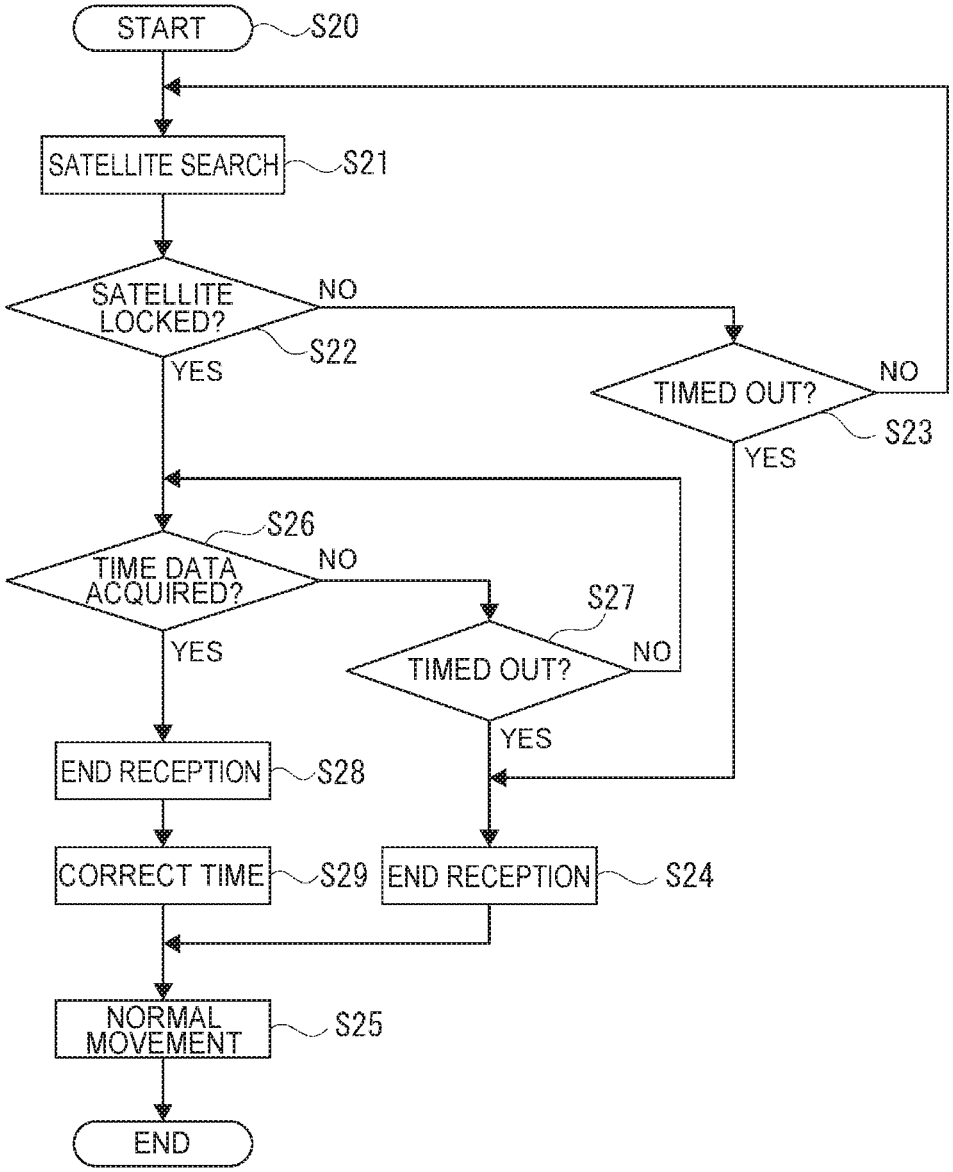
FIG. 18 is a flow chart of the timekeeping reception process in this embodiment of the invention.

The timekeeping reception process (S20) shown in FIG. 18 is described next. The process in FIG. 18 is executed in this embodiment of the invention when the reception mode is indicated by hand 26 in S9.

The timekeeping reception controller 643 starts a satellite search (S21). Next, the timekeeping reception controller 643 determines if a satellite was locked onto (S22). If S22 returns NO because a satellite cannot be locked, the timekeeping reception controller 643 determines if the time past since the timekeeping reception process started has reached a specific timeout time (such as 15 seconds) for locking onto a satellite (S23).

If the timeout time was passed in S23 and operation timed out (S23 returns YES), the timekeeping reception controller 643 stops reception (S24), and the controller 61 resumes normal operation of the movement (S25).

However, if operation did not time out in S23 (S23 returns NO), the timekeeping reception controller 643 continues the satellite search process of S21.

If a satellite was locked onto in S22 (S22 returns YES), the timekeeping reception controller 643 determines if the time data (Z count) was acquired (S26). Note that if plural satellites are locked, time data may be acquired from the satellite signal with the highest signal strength (SNR), or time data may be acquired from plural satellites, the coherence of the time data checked, and the success of time data acquisition determined.

If S26 returns NO, the timekeeping reception controller 643 determines if a specific timeout time (such as 30 seconds) has passed (S27).

If S27 returns NO, the timekeeping reception controller 643 repeats S26. Because the Z count can be received at a 6-second interval from a GPS satellite signal, the Z count can be received five times before operation times out if the timeout time in S27 is set to 30 seconds.

If operation times out in S27 (S27 returns YES), the timekeeping reception controller 643 ends the reception process (S24), and resumes normal operation of the movement (S25).

However, if S26 returns YES, the timekeeping reception controller 643 ends reception (S28), and the time information correction unit 610 corrects the time information based on the acquired time data (S29). When the time information correction unit 610 corrects the time information, the display controller 620 adjusts the time indicated by the second hand 21, minute hand 22, and hour hand 23 through the drive circuit 62 based on the corrected time information, returns hand 26 to indicate the day, and then resumes normal operation of the movement (S25).

The timekeeping reception process executed when an automatic reception condition is met thus ends. When the timekeeping reception process ends, the controller 61 returns to S1 in FIG. 17 and continues the process.

Positioning Reception Process

Figure 19:
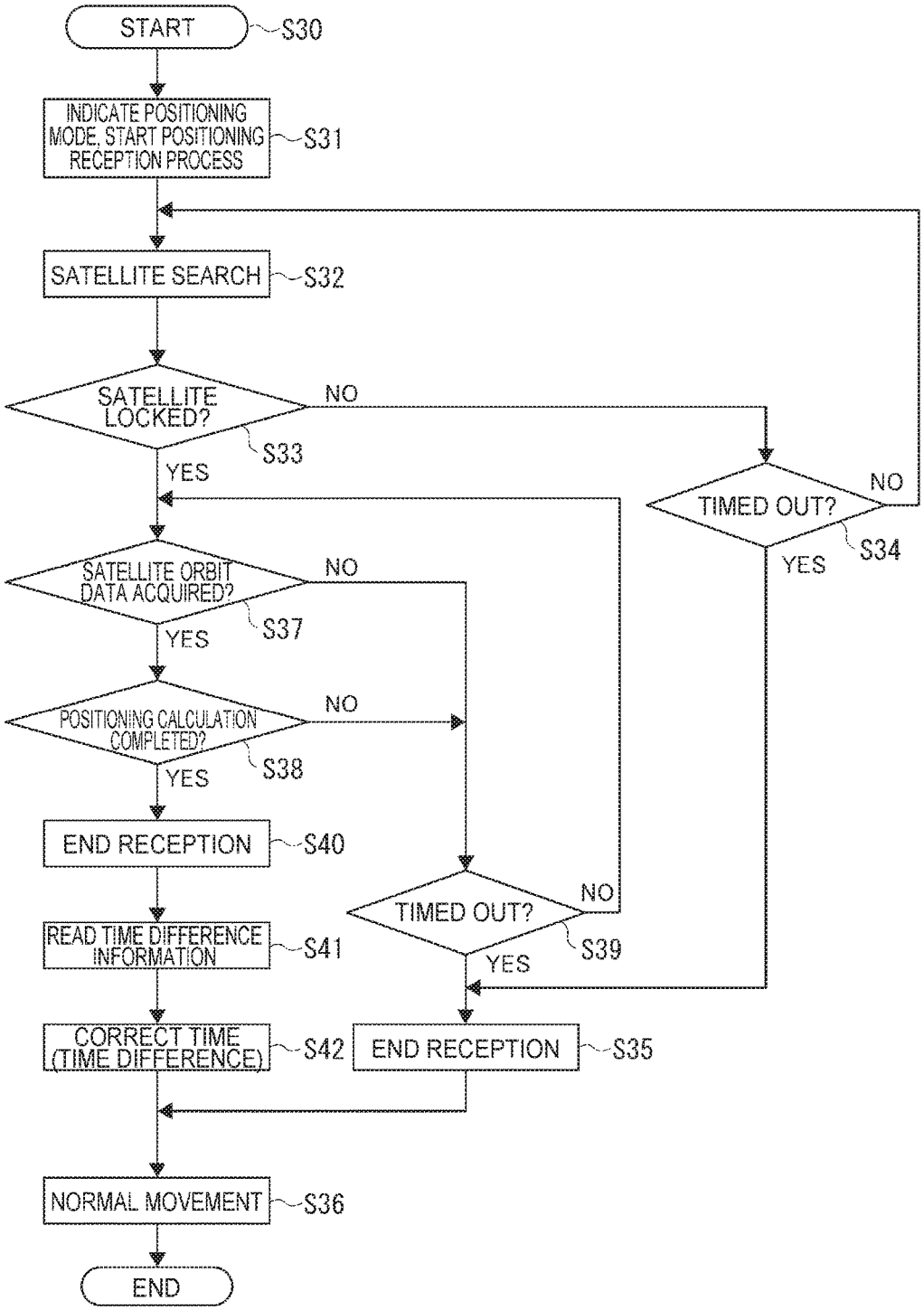
FIG. 19 is a flow chart of the positioning reception process in this embodiment of the invention.

The positioning reception process S30 is described next with reference to FIG. 19.

When the positioning reception process S30 starts, the display controller 620 indicates with hand 26 that the positioning reception process is executing (S31). More specifically, the display controller 620 sets hand 26 to the 4+ marker on the left side of the second subdial 13 during the positioning reception process. In addition, the positioning reception controller 644 outputs a control signal to the GPS receiver 500 to start the positioning reception process (S31).

When starting the positioning reception process is instructed, the GPS receiver 500 (baseband unit 520) starts the satellite search process (S32).

The GPS receiver 500 determines a GPS satellite S was locked onto in the satellite search process if the satellite signal reception level is greater than or equal to a specific level.

The GPS receiver 500 also determines if satellite signals were received from at least the specific number of satellites required for positioning (at least 3 and normally 4) (S33).

If S33 returns NO, the GPS receiver 500 determines if the timeout period for the satellite search has passed (S34). The timeout time for the satellite search process is, for example, 15 seconds.

If S34 returns NO, the GPS receiver 500 continues the satellite search process of S32.

If S34 returns YES, the GPS receiver 500 ends the satellite search process (S35), and the controller 61 resumes normal operation of the movement (S36). This is to avoid continuing the reception process and unnecessarily consuming power from the storage battery 130 because the electronic timepiece 1 is in an environment where locking onto a GPS satellite S is not possible.

If S33 returns YES, the GPS receiver 500 determines if satellite orbit data (ephemeris) was acquired from the locked satellite signal (S37).

If S37 returns YES, the GPS receiver 500 calculates the location based on the acquired satellite orbit data, and determines if the positioning calculation was completed (S38).

If NO is returned by S37 or S38, the GPS receiver 500 determines if the timeout period for the positioning calculation past (S39). This positioning calculation timeout period is 120 seconds, for example.

If operation has timed out in S39 (S39 returns YES), the GPS receiver 500 ends the reception process (S35), and the controller 61 resumes normal operation of the movement (S36).

However, if operation has not timed out in S39 (S39 returns NO), the GPS receiver 500 returns to S37 and continues the process.

If S38 returns YES, the GPS receiver 500 ends the reception process (S40), reads, from the time difference database stored in flash memory 540, the time difference information corresponding to the location determined from the positioning calculation, and outputs to the controller 61 (S41).

The time information correction unit 610 of the controller 61 then corrects the time information using the time difference information output from the GPS receiver 500, and the display controller 620 displays the corrected time with hands 21, 22, 23 (S42). Next, the controller 61 resumes normal operation of the movement (S36).

The positioning reception process executed when an automatic reception condition is met thus ends. When the positioning reception process ends, the controller 61 returns to S1 in FIG. 17 and continues the process.

Standard Time Signal Reception Process

Figure 20:
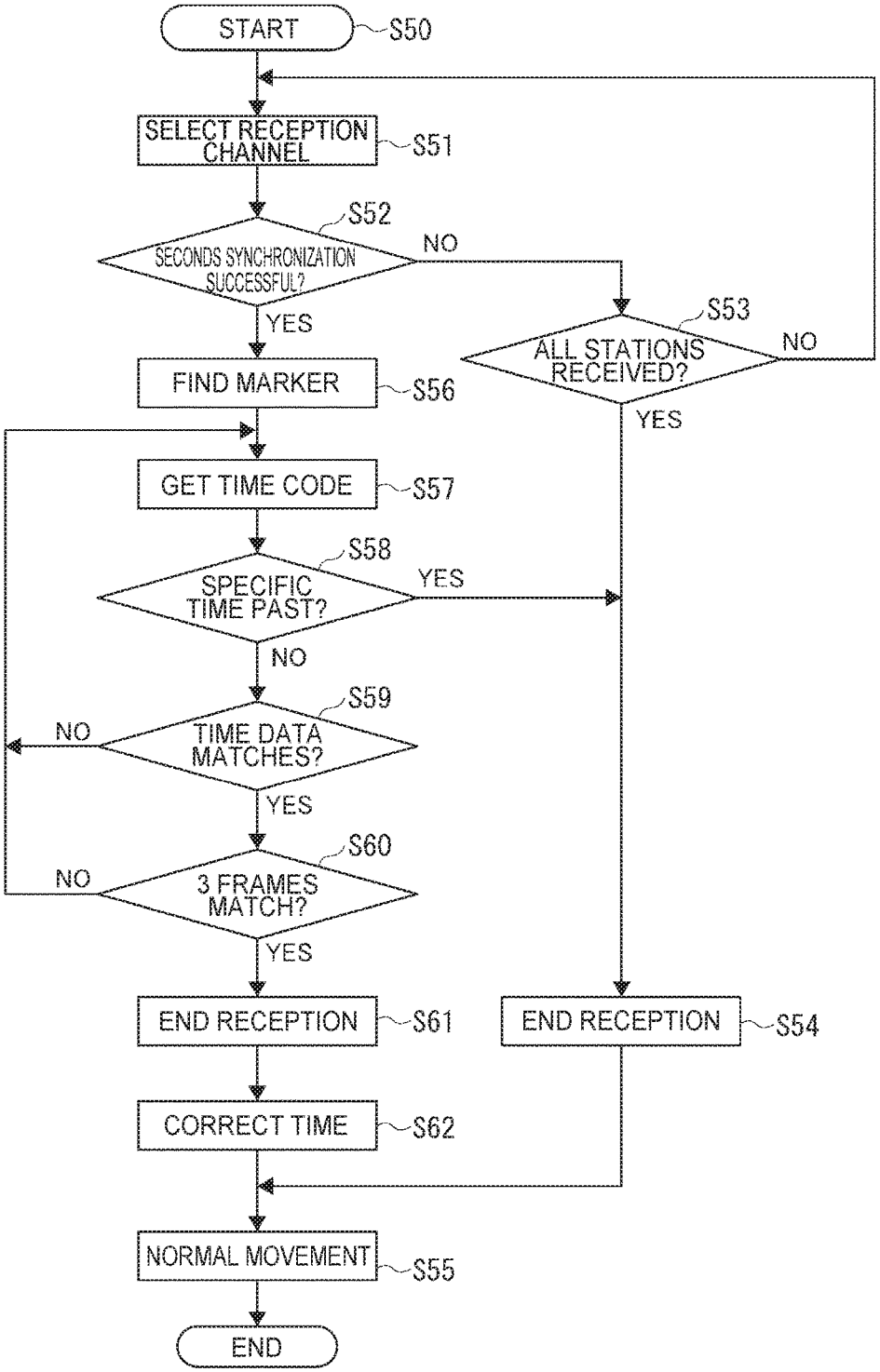
FIG. 20 is a flow chart of the standard time signal reception process in this embodiment of the invention.

The standard time signal reception process (S50) shown in FIG. 20 is described next.

When the reception process starts, the controller 61 selects the reception station (type of standard time signal) (S51). As described above, the reception station is selected based on the location acquired in the positioning reception process, or the time zone data selected and set by the user. If the previous reception process was successful, the previous reception station is used.

Next, the controller 61 executes a seconds synchronization process based on the TCO signal output from the binarization circuit 417 (S52). The controller 61 confirms seconds synchronization by determining if the rising edge of the input TCO signal is at a one-second interval.

If seconds synchronization in S52 fails (S52 returns NO), the controller 61 determines if reception of all stations has ended (S53). If S53 returns NO, the controller 61 returns to reception station selection in S51, selects a different reception station, and continues the process. Note that the "all stations" evaluated in S53 means all standard time signals that can be received by the electronic timepiece 1 (for example, if JJY40, JJY60, WWVB, BPC, DCF77, MSF can be received, all of these signals), or only the stations that can be received based on the positioning information acquired from the positioning calculation (for example, MSF and DCF77 if the positioning information indicates London).

If S53 returns YES, the controller 61 determines that a standard time signal cannot be received, ends the process (S54), and resumes normal operation of the movement (S55).

If the controller 61 determines in S52 that seconds synchronization was successful, it acquires the marker indicating the 0 second position in the time code for frame synchronization (S56). For example, in the JJY standard time signal of Japan, the point where the M marker follows the P0 marker denotes the starting point of the time code, and frame synchronization can be confirmed by detecting these contiguous markers.

When these markers are acquired and frame synchronization is confirmed, the controller 61 decodes the TCO signal output from the binarization circuit 417 and acquires the time code (TC) (S57).

Next, the controller 61 determines if a specific time (such as 5 minutes) has past since reception started (S58). If S58 returns YES, the controller 61 determines that power would be consumed wastefully without being able to receive the standard time signal even if the reception process continues, therefore ends the reception process (S54), and resumes normal operation of the movement (S55).

If NO is returned in S58, the controller 61 determines if the time data is coherent (S59). More specifically, the controller 61 checks the parity bit or if the time data is a time that does not exist.

If YES is returned in S59, the controller 61 determines if 3 frames of data are coherent (S60). If the time data acquired from three continuous time codes are at a one minute interval, it determines the three frames are coherent.

The controller 61 returns to the time code acquisition process of S57 if S59 or S60 returns NO.

If S60 returns YES, the controller 61 ends the standard time signal reception process because the correct time code was acquired (S61). Next, the controller 61 corrects the internal time based on the acquired time code (S62), and then resumes normal operation of the movement (S55).

The standard time signal reception process executed when an automatic reception condition is met thus ends. When this standard time signal reception process ends, the controller 61 returns to S1 in FIG. 17 and continues the process.

Manual Reception Process

In this embodiment of the invention the standard time signal reception process executes only in an automatic reception process, but the GPS reception process (timekeeping reception process, positioning reception process) can also be started manually by operating button A 36. The actual reception processes executed as manual reception processes are the same as the automatic reception processes, and further description thereof is omitted.

Effect of the Invention

Because the electronic timepiece 1 has two reception units, a satellite signal receiver 5 and a standard time signal receiver 4, for receiving two types of signals, the probability of being able to acquire time information can be improved.

A thin electronic timepiece 1 can also be provided because of the parts housed inside the external case 30 of the electronic timepiece 1, the relatively thick planar antenna 40, bar antenna 150, and storage battery 130 are disposed to locations not superimposed with each other in plan view.

A thin electronic timepiece 1 can also be achieved because the stepper motors 141 to 145 are disposed to locations not superimposed in plan view with the planar antenna 40 and bar antenna 150.

Furthermore, because three of the plural stepper motors 141 to 145, that is, first stepper motor 141, third stepper motor 143, and fifth stepper motor 145, are disposed superimposed in plan view with the storage battery 130, the diameter of the external case 30 can be reduced and a smaller electronic timepiece 1 can be provided than when all of the stepper motors 141 to 145 are disposed superimposed in plan view with the storage battery 130.

Furthermore, because the stepper motors 141 to 145 and storage battery 130 are thinner than the planar antenna 40 and bar antenna 150, even if stepper motors 141, 143, 145 are superimposed in plan view with the storage battery 130, the thickness of the electronic timepiece 1 can be reduced and a thinner electronic timepiece 1 can be provided than when the stepper motors 141 to 145 are superimposed in plan view with the antennae 40, 150.

Furthermore, because the metal battery functions as a magnetic shield when the stepper motors 141 to 145 are superimposed in plan view with the storage battery 130, the stepper motors 141 to 145 can be prevented from operating incorrectly due to external magnetic fields.

Furthermore, because of the plural pivots 27 to 29 pivots 27, 28 are disposed superimposed in plan view with the storage battery 130, when the hands 21 to 25 are pushed onto the pivots 27, 28, the force applied to the pivots 27, 28 can be supported by the storage battery 130. In other words, the wheel train bridge 127, first circuit board 710, second magnetic shield 92, spacer 128, and storage battery 130 are stacked sequentially. As a result, the force applied when the hands 21 to 25 are pushed onto the pivots 27, 28 can be borne by the metal storage battery 130, which has greater strength than a plastic part, and the hands can be reliably and stably installed.

Furthermore, because a notch 810 is formed in the solar cell panel 80, and the electrodes 82, 84 are not superimposed in plan view with the planar antenna 40, a drop in the performance of the planar antenna 40 can be prevented.

Furthermore, because the electrodes 82, 84 of the solar cell panel 80 and the bar antenna 150 are superimposed in plan view, the area of the solar panel can be increased and sufficient power output can be assured.

Furthermore, because the antennae 40, 150 and the receiver chips (GPS chip 501, standard time signal receiver chip 401) for the antennae 40, 150 are all mounted on the second circuit board 720, the signal path from the antennae 40, 150 to the corresponding GPS chip 501 or standard time signal receiver chip 401 is short, and the chance of noise affecting the signals received by the antennae can be reduced. As a result, the receiver chips can process signals with less noise, and the chance of acquiring correct time information can be improved.

Furthermore, because the power control chip 711 and CPU chip 712 for controlling driving the stepper motors 141 to 145 are disposed to a first circuit board 710, which is discrete from the second circuit board 720, the second circuit board 720 and first circuit board 710 can be separated from each other, and the drive signals of the stepper motors 141 to 145 can be prevented from affecting the received signals.

Because the movement 2 of the electronic timepiece 1 has two magnetic shields, first magnetic shield 91 and second magnetic shield 92, the first magnetic shield 91 and second magnetic shield 92 can be respectively disposed on the face side and the back cover side of the stepper motors 141 to 145. The effects of external magnetic fields can therefore be prevented from the face and back cover sides of the first stepper motor 141, and incorrect operation of the stepper motors 141 to 145 can be prevented.

Furthermore, because the portions of the magnetic shields 91, 92 that would overlap the antennae 40, 150 in plan view are omitted, signals received by the antennae 40, 150 are not obstructed by the magnetic shields 91, 92, and good reception performance can be assured.

Furthermore, because the satellite signal receiver 5 is configured so that the satellite signal reception controller 642 only determines the automatic reception condition is met if the battery voltage is greater than or equal to the second specific value, the system can be reliably prevented from shutting down due to the battery voltage dropping as a result of the satellite signal receiver 5 operating.

Because the standard time signal receiver 4 is enabled by the standard time signal reception controller 645 to operate if the battery voltage is greater than or equal to the first specific value, the standard time signal receiver 4 can operate even if the battery voltage is less than the second specific value. As a result, more opportunities to operate the standard time signal receiver 4 can be created, and deviation in the kept time can be reduced.

Furthermore, because the standard time signal receiver 4 blocks reception if the remaining battery capacity is less than a first specific value, a system shutdown caused by the power supply dropping below the minimum operating voltage of the controller 61 can be reliably prevented.

The standard time signal reception controller 645 can also execute the standard time signal reception process every day at a scheduled time because the standard time signal receiver 4 operates when the kept time reaches a set reception time. Because the satellite signal reception controller 642 operates the satellite signal receiver 5 only when standard time signal reception is not successful, the satellite signal receiver 5 can be operated when operation of the standard time signal receiver 4 is prioritized but a standard time signal cannot be received. As a result, time information can be acquired by the low current consumption standard time signal receiver 4 when the electronic timepiece 1 is used in a place where a standard time signal can be received, and time information can be acquired by the satellite signal receiver 5 when in a location where a standard time signal cannot be received. Power consumption by the reception process for acquiring time information can therefore be suppressed.

Because the second specific value, which is the condition for operating the satellite signal receiver 5, is set to a level at which the remaining battery capacity will not drop during the positioning reception process to a level at which a system shutdown will occur, a system shutdown can be reliably prevented even when the positioning reception process, which consumes more current than the timekeeping reception process, executes.

Because being outdoors can be determined by the voltage detection circuit 74 detecting the power output of the solar cell panel 80, whether or not the electronic timepiece 1 is outdoors where satellite signal reception is easy can be determined. The probability of satellite signal reception succeeding automatically can therefore be improved.

By having a hand 26 and a second subdial 13 for indicating the remaining battery capacity, the remaining battery capacity can be displayed when reception starts. The user can therefore know if the reception process does not execute because of a low battery. Because the user can thus know why reception failed, the user can take appropriate action to charge the battery to meet the reception condition, and user convenience can be improved.

Furthermore, because the display controller 620 can indicate with the hand 26 that the positioning reception or timekeeping reception process is executing, the user can easily know the current reception mode.

Because the power supply unit 7 includes a solar cell panel 80 and storage battery 130, the user can know to produce power with the solar cell panel 80 to charge the storage battery 130 if the remaining battery capacity drops below one of the thresholds and the reception process cannot execute. The reception process can therefore be run the next time the reception operation is performed if the remaining battery capacity rises above the thresholds.

Other Embodiments

The invention is not limited to the foregoing embodiment, and can be varied in many ways without departing from the scope of the accompanying claims.

For example, the layout of the planar antenna 40, bar antenna 150, storage battery 130, and stepper motors 141 to 145 is not limited to the embodiment described above. For example, the date window 15 may be formed between 4:00 and 5:00 on the dial 11 so that the date window 15 and planar antenna 40 are superimposed in plan view as shown in movement 2A in FIG. 21. As a result, the planar antenna 40 is disposed between 4:00 and 6:00 on the dial 11, and the storage battery 130 is disposed offset toward 11:00 from the center of the dial 11. The bar antenna 150 is disposed at 9:00 on the dial 11 as in the embodiment described above. As a result, the planar antenna 40, bar antenna 150, and storage battery 130 are disposed not overlapping each other in plan view.

If the date window 15 is formed at a position superimposed in plan view with the planar antenna 40, the date indicator 20 can be seen from the date window 15 through the notch 915 in the first magnetic shield 91 and the notch 810 in the solar cell panel 80. As a result, there is no need to form an opening 820 in addition to the notch 810 in the solar cell panel 80, and the area occupied by the solar cells can be increased. There is also no need to form a notch 911 in addition to notch 915 in the first magnetic shield 91, the number of production steps is therefore reduced, and magnetic resistance can be improved.

The notches 911, 915 and edge 916 of the first magnetic shield 91, and the notch 925 and edge 926 of the second magnetic shield 92, can be formed simultaneously in a stamping process when manufacturing the first magnetic shield 91 and second magnetic shield 92, but may also be formed after stamping the first magnetic shield 91 and second magnetic shield 92.

Likewise, the notch 713 and straight side 714 of the first circuit board 710, and the notch 721 of the second circuit board 720, can be formed simultaneously when manufacturing the circuit boards 710, 720, or they may be cut out or otherwise formed thereafter. This also applies to the notch 810 in the solar cell panel 80.

In other words, the solar cell panel 80, first magnetic shield 91, second magnetic shield 92, and first circuit board 710 may be configured in many ways without being superimposed in plan view with the planar antenna 40 and bar antenna 150, and the method of forming the notches and cut-off edges is not specifically limited.

The location of the bar antenna 150 is not limited to the 9:00 position of the dial 11, and may be at 12:00 or 6:00. The location of the bar antenna 150 is also not limited to 6:00, 9:00, or 12:00, but is preferably located at any 90 degree position (that is, 6:00, 9:00, or 12:00) other than 3:00, where the bar antenna 150 cannot be disposed because of the stem 381. More specifically, a bar antenna 150 for receiving standard time signals has directivity, and must face the transmission tower (standard time signal transmitter R). Therefore, if the bar antenna 150 is disposed to a 90 degree position (that is, 6:00, 9:00, or 12:00), the location of the bar antenna 150 is also easier for the user of the electronic timepiece 1 to know. The user can then execute the standard time signal reception operation while directing the bar antenna 150 toward the transmission tower, and standard time signals can be received more easily.

Figure 21:
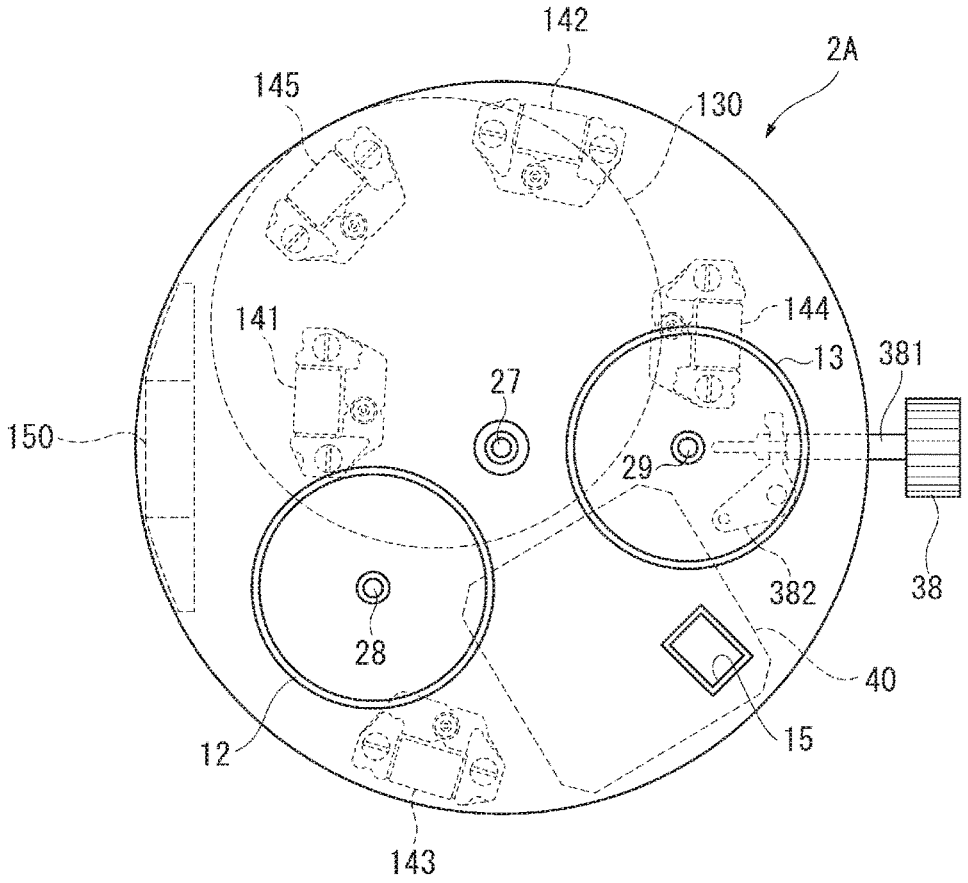
FIG. 21 illustrates the relative positions of the planar antenna, bar antenna, battery, and stepper motors in a variation of the invention.

In the movement 2A shown in FIG. 21, the stepper motors 141 to 145 and pivots 27 to 29 are disposed to positions not superimposed in plan view with the planar antenna 40 and bar antenna 150. Some of the stepper motors 141 to 145 are disposed superimposed in plan view with the storage battery 130. The same effect as described above can therefore be achieved.

In the embodiment described above, hand 26 normally indicates the day of the week, and indicates the voltage (power reserve) of the storage battery 130, or the reception mode during the satellite signal reception process, when button A 36 is pushed, but a separate hand that always indicates the reserve power of the storage battery 130 may be provided. In this case, the user can readily know when the voltage of the storage battery 130 has dropped, and the user can be prompted to charge the storage battery 130 with the solar cell panel 80.

The electronic timepiece 1 is also not limited to having a first subdial 12 and second subdial 13, and the information indicated on the first subdial 12 or second subdial 13 may be the chronograph time indicated by a chronograph hand.

Indicating the reception mode is also not limited to the hand 26, and the reception mode may be indicated by the second hand 21 using markings such as a 1 marker denoting the timekeeping reception mode, 4+ marker indicating the positioning reception mode, and RC indicating the standard time signal reception mode, on the dial 11 or dial ring 35. The reception result may also be indicated by the second hand 21.

During the automatic reception process, hand 26, for example, may also be configured to not move to the position indicating the reception mode. This is because the automatic reception process typically runs when the electronic timepiece 1 is not being worn and the user is not looking at the hand 26. However, if the hand 26 indicates the reception mode and that reception is in progress during the automatic reception process, the user can also know reception information during the automatic reception process.

The time display unit of the electronic timepiece in the foregoing examples is embodied by a dial 11 and hands 21, 22, 23, but the invention is not so limited. The electronic timepiece may have a time display unit embodied by an LCD panel, for example. In this event, the driver that drives the time display unit is embodied by a driver that drives a liquid crystal display panel.

The electronic timepiece also simply needs a time display function, and the time display unit does not need to be a dedicated display unit for displaying time. Examples of such electronic timepieces include heart rate monitors worn on the user's wrist, GPS loggers that are worn on the user's wrist and monitor and log the current location while the user is jogging, and other types of wearable devices.

A GPS satellite is used as an example of a positioning information satellite above, but the invention is not so limited. For example, the positioning information satellite may be a satellite used in a Global Navigation Satellite System (GNSS) such as Galileo (EU) or GLONASS (Russia). Geostationary satellites in a geostationary satellite-based augmentation system (SBAS), and quasi-zenith satellites (such as Michibiki) used in a regional navigation satellite system (RNSS) that can only be accessed in specific regions, can also be used.

The types of standard time signals that can be received are also not limited to the standard time signals of the five countries described above, and configurations that receive only some of these standard time signals are also conceivable.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2016-045576, filed Mar. 9, 2016 is expressly incorporated by reference herein.

What is claimed is:

1. An electronic timepiece comprising:

a planar antenna for receiving satellite signals, a bar antenna for receiving standard time signals, a time display unit with a plurality of hands, a plurality of motors for driving the hands, a battery, and a timepiece case, wherein:

the planar antenna, bar antenna, and battery are disposed to positions not mutually superimposed in plan view inside the timepiece case;

the plural motors are disposed inside the timepiece case at positions not superimposed in plan view with the planar antenna and bar antenna; and at least one of the plural motors is disposed superimposed in plan view with the battery inside the timepiece case.

2. The electronic timepiece described in claim 1, further comprising:

a solar cell disposed inside the timepiece case, the electrode layer of the solar cell not superimposed in plan view with the planar antenna, and the electrode layer of the solar cell superimposed in plan view with the bar antenna.

3. The electronic timepiece described in claim 1, further comprising:

a first circuit board and a second circuit board inside the timepiece case;

a control chip for controlling driving the motors, and a power control chip for controlling a power supply including the battery, being disposed to the first circuit board; and the planar antenna, bar antenna, a satellite signal receiver chip for controlling receiving satellite signals by the planar antenna, and a standard time signal receiver chip for controlling receiving standard time signals by the bar antenna, being disposed to the second circuit board.

4. An electronic timepiece described in claim 1, wherein:

a first magnetic shield and a second magnetic shield are disposed inside the timepiece case;

the first magnetic shield and second magnetic shield being not superimposed in plan view with the planar antenna and bar antenna.

5. An electronic timepiece comprising:

a planar antenna for receiving satellite signals, a bar antenna for receiving standard time signals, a time display unit with a plurality of pivots and hands attached to the pivots, a plurality of motors for driving the hands, a battery, and a timepiece case, wherein:

the planar antenna, bar antenna, and battery are disposed to positions not mutually superimposed in plan view inside the timepiece case;

the plural pivots are disposed inside the timepiece case at positions not superimposed in plan view with the planar antenna and bar antenna; and at least one of the plural pivots is disposed superimposed in plan view with the battery inside the timepiece case.

* * * * *